US010494237B2

(12) United States Patent
Köster et al.

(10) Patent No.: US 10,494,237 B2
(45) Date of Patent: Dec. 3, 2019

(54) CRANE, DEVICE AND METHOD FOR DEFLECTING FORCES ON A CRANE

(71) Applicant: Terex Global GmbH, Schaffhausen (CH)

(72) Inventors: Fritz-Botho Köster, Rockenhausen (DE); Benjamin Schaal, Zweibrücken (DE); Alfons Weckbecker, Zweibrücken (DE); Frank Schnittker, Würzburg (DE)

(73) Assignee: TEREX GLOBAL GMBH, Schaffhausen (CH)

( * ) Notice: Subject to any disclaimer, the term of this patent is extended or adjusted under 35 U.S.C. 154(b) by 246 days.

(21) Appl. No.: 15/319,880

(22) PCT Filed: Jul. 13, 2015

(86) PCT No.: PCT/EP2015/065966

§ 371 (c)(1),
(2) Date: Dec. 19, 2016

(87) PCT Pub. No.: WO2016/008842

PCT Pub. Date: Jan. 21, 2016

(65) Prior Publication Data

US 2017/0129752 A1 May 11, 2017

(30) Foreign Application Priority Data

Jul. 15, 2014 (DE) ..... 10 2014 213 724

(51) Int. Cl.
*B66C 23/78* (2006.01)
*B66C 13/16* (2006.01)
*B66C 23/84* (2006.01)

(52) U.S. Cl.
CPC ..... *B66C 23/78* (2013.01); *B66C 13/16* (2013.01); *B66C 23/84* (2013.01)

(58) Field of Classification Search
CPC ..... B66C 23/78; B66C 23/84; B66C 23/88; B66C 13/16
See application file for complete search history.

(56) References Cited

U.S. PATENT DOCUMENTS 882,034 A * 3/1908 Ward ..... B66C 23/78 212/302
1,393,360 A * 10/1921 Harris ..... B66C 23/78 180/350
4,332,328 A 6/1982 Otto et al.

FOREIGN PATENT DOCUMENTS

CN 102745604 A 10/2012
DE 2844819 A1 4/1980
(Continued)

OTHER PUBLICATIONS

Translation of DE102011119655, espacenet.com (Year: 2018).*
International Search Report of PCT/EP2015/065966 dated Sep. 16, 2016.

*Primary Examiner* — Sang K Kim
*Assistant Examiner* — Nathaniel L Adams
(74) *Attorney, Agent, or Firm* — Browdy and Neimark, PLLC

(57) ABSTRACT

A crane includes an under carriage, an upper carriage, a rotary connection, by means of which the upper carriage is connected with the under carriage to rotate around an axis of rotation, a jib to be connected with the crane and erected around a jib axis, and a device connecting the upper carriage with the under carriage with at least one force-transmitting element. The at least one force-transmitting element is designed passively in such a way that it transmits forces between the upper carriage and the under carriage when a pre-determined load condition of the rotary connection is reached.

19 Claims, 17 Drawing Sheets

(56) References Cited

FOREIGN PATENT DOCUMENTS

| | | | |
|---|---|---|---|
| DE | 3531291 | A1 | 3/1987 |
| DE | 102011119655 | A1 | 5/2013 |
| FR | 628249 | A | 9/1927 |

* cited by examiner

CRANE, DEVICE AND METHOD FOR DEFLECTING FORCES ON A CRANE

CROSS-REFERENCES TO RELATED APPLICATIONS

This application claims the priority of German Patent Application, Serial No. 10 2014 213 724.1, filed pursuant to 35 U.S.C. 119(a)-(d) the contents of which is incorporated herein by reference in its entirety as if fully set forth herein.

FIELD OF THE INVENTION

The invention concerns a crane, a device and a method for deflecting forces on a crane.

BACKGROUND OF THE INVENTION

A crane with an erectable jib is known from CN 102 745 604 A. The jib is swivel-mounted on an upper carriage of the crane in a foot area. The jib is connected with an erection device, actuated by means of a rope reeving, in a head area for erecting the same. Related to an axis of rotation of a rotary connection arranged between the upper carriage and the under carriage of the crane the linkage of the jib is off centre. An anchoring rod is bolted to bores between the upper carriage and the under carriage envisaged for this in order to avoid an undesired load on the rotary connection. The anchoring rod enables a direct introduction of tensile forces from the upper carriage into the under carriage when the jig is erected. The anchoring rod requires high dimensional accuracy in order to guarantee that the bolting of the anchoring rod to the upper carriage and the under carriage is possible without difficulty. Fitting the anchoring rod at the specifically stipulated distance from installation openings is problematic in particular when a counterweight is arranged on the upper carriage, which for example varies depending on the jib to be erected.

DE 35 31 291 A1 discloses a supporting swing jib crane with a rotary platform which is rotatable on a track of a foundation by means of supporting rollers. Vertical forces occurring as a consequence of dropping load are transmitted by the rollers to the track.

DE 28 44 819 A1 discloses a mobile crane for heavy loads. An upper carriage, with an intermediate frame and load roller arranged thereon, is vertically positively driven between a track ring and a frame.

A crane with an erectable jib is known from DE 10 2011 119 655 A1. An actively length-adjustable hydraulic cylinder is envisaged as a force-limited connection element in order to take the load off the reel connection between the upper carriage and the under carriage. An active hydraulic cylinder is comparatively heavy, in particular compared to an anchoring rod, needs to be controlled or regulated, is prone to faults, cost intensive and maintenance intensive. An active hydraulic cylinder also requires a complex hydraulic supply.

SUMMARY OF THE INVENTION

It is an object of the present invention to improve the force flow in a crane in such a way that the forces transmittable between upper carriage and under carriage are increased.

This object is solved by a crane comprising a. an under carriage, b. an upper carriage, c. a rotary connection, by means of which the upper carriage is connected with the under carriage to rotate around an axis of rotation, d. a jib and e. a device connecting the upper carriage with the under carriage, comprising at least one force-transmitting element.

It has been found according to the invention that a device with at least one force-transmitting element for increasing forces transmittable between an upper carriage and an under carriage of the crane can be passively designed. The force-transmitting element thus enables an increase of the transmittable forces between under carriage and upper carriage in addition to the present rotary connection. The device can for example comprise precisely one force-transmitting element, precisely two force-transmitting elements or precisely three force-transmitting elements. The device can also comprise more than three force-transmitting elements. It is therefore in particular not necessary that an active element, such as for example a hydraulic cylinder, is used for avoiding an overloading of the existing rotary connection. Passive means that the force-transmitting element is unsuitable for applying a force onto a cooperating component by itself. The force-transmitting element is arranged outside of an active surface of the rotary connection. The active surface of the rotary connection, in particular, is a circular surface defined by bearing rings. The force-transmitting element is a component separate from the rotary connection. In particular, the force-transmitting element is no component of the rotary connection of the crane. The device effects an additional force flow outside of the active surface of the rotary connection when a pre-determined load condition of the rotary connection is reached. In particular, the pre-determined load condition for different cranes can be set variably such that one and the same force-transmitting element is used for different cranes. Since the different cranes typically have different geometries and/or rigidities, the cranes are differently deformable. Accordingly, one and the same force-transmitting element produces different pre-set load conditions in differently deformable cranes. The load condition is for example characterised by a deformation of the crane, in particular by a bending of the upper carriage against the under carriage or in relation to a horizontal plane. Due to the fact that the device comprises a passive force-transmitting element, a resulting force can be arranged outside of an active surface of the rotary connection as soon as the force-transmitting element transmits a force from the upper carriage to the under carriage via the device connecting the upper carriage with the under carriage. A force transmission by the device, in particular the force-transmitting element, is realised when an external load—for example as a consequence of erecting the jib—is so great that the pre-set deformation is reached and the force-transmitting element produces a positive-locking connection between the upper carriage and the under carriage. A positive-locking connection is given when a geometric play between the force-transmitting element and the upper carriage and/or the under carriage, in particular as a consequence of an inclination of the upper carriage due to an external load, is exhausted. In addition or alternatively the geometric play can also be envisaged inside the force-transmitting element itself. For this it will be necessary that the force-transmitting element is designed in at least two parts. When positive locking occurs, force will be transmitted from the upper carriage, i.e. directly via the force-transmitting element, into the under carriage. If the force-transmitting element is not activated, a force transmission will take place only via the rotary connection, and in particular not via the force-transmitting element. The geometric size of the play between the force-transmitting element and the upper carriage and/or the under carriage as well as inside the force-transmitting element itself determines the pre-determined load condition, from which the initially passive force-transmitting element becomes activated to transmit force. The geometric play is also designated as idle stroke. The geometric play and the idle stroke, respectively, have a dimension exceeding typical fabrication tolerances and in particular exceeding typical fabrication tolerances by at least one order. A specific settable load degree on the rotary connection in particular is consciously tolerated with the device according to the invention. The tolerated load on the rotary connection is unproblematic. Contrary to the device known from CN 102 745 604 A, the device according to the invention has improved flexibility. In particular, considerable problems arise when mounting such a device without idle stroke due to fabrication tolerances and different deformation conditions of the upper carriage due to the arrangement of dead weight. The device according to the invention thus enables the at least proportional absorption of vertically acting forces from the upper carriage, and the onward transmission of the same to the under carriage. Such forces occur during the erection of the jib. The crane according to the invention therefore enables the erection of longer and/or heavier jibs. In addition, or alternatively, it is possible to design the crane with a lighter counterweight. Components located on the crane, in particular the rotary connection between upper carriage and under carriage, become effective, and in particular can be used in the best possible way. The device in particular enables with the at least one force-transmitting element that forces to be transmitted are located outside of the active surface of the rotary connection. It is enabled with the device with the at least one force-transmitting element that the forces to be transmitted have force effect lines that do not intersect the circular surface of the roller bearing slew ring. It is of advantage if a vertical distance of the effect line of the forces to be transmitted to the active surface of the rotary connection is as large as possible.

The device is designed in an uncomplicated way and in particular cost effectively compared to an active device in the form of a hydraulic cylinder. Constructive effort in particular is reduced. Maintenance effort and control effort are omitted. The fact that the device transmits force only once the pre-defined load condition is reached means that the load-bearing capacity of the rotary connection itself and that of the upper carriage can be utilised and the device can be designed to a smaller force to be transmitted. The device known from C 102 745 604 A directly transmits forces between the upper carriage and the under carriage. To guarantee that the device is also suitable for the pre-set load condition of the rotary connection the latter has to be designed overdimensioned as compared to the device according to the invention. The device of the crane according to the invention is uncomplicated to use and can in particular be installed without problems, and in particular upgraded.

The main function of the force-transmitting element is the increase in the transmittable forces between the upper carriage and the under carriage. As an auxiliary function, the force-transmitting element can serve as overload protection of the rotary connection between the upper carriage and the under carriage for example during regular operation of the crane, i.e. during the lifting of a load, and in particular during erection of a boom. An additional or alternative auxiliary function can be the warranty of the safety of the crane. The at least one force-transmitting element is for example arranged as a tie on a rear side of the crane facing away from the boom and/or as a pressure element on a front side facing towards the boom.

A crane where the at least one force-transmitting element is arranged on a force transmitting level symmetrical to the axis of rotation enables a force transmission that is symmetrical to the axis of rotation on the force transmission plane in relation to said axis of rotation. The force transmission plane is oriented parallel to a horizontal axis and parallel to the axis of rotation. In particular the at least one force-transmitting element is arranged on the force transmitting plane. The force transmitting plane is in particular a vertical plane. The horizontal axis is oriented parallel to a jib axis, around which the jib can be erected on the crane. The horizontal axis is oriented horizontally when the crane is arranged horizontally on the ground. If the crane is arranged at an incline, i.e. at an angle of inclination that differs from a horizontal plane of 0, the horizontal axis is also arranged, inclined by this angle of inclination in relation to the horizontal plane. The device with the at least one force-transmitting element is ideally arranged symmetrically to a mid-surface of a crane, which is in particularly formed by the rotary axis of the upper carriage and the longitudinal axis of the boom. For the case that precisely one force-transmitting element is envisaged, this is arranged on a projection of the axis of rotation on the force transmitting plane. If two force transmitting elements are envisaged, these are each arranged at the same distance and symmetrical to the axis of rotation on the force transmitting plane. This guarantees that the force flow from the upper carriage via the device into the under carriage is symmetrical. A torque directed transverse to the erection plane, in particular vertical to a jib axis around which the jib is swivel-mounted on the crane, which influences the stability of the crane, in particular during the erection process, is avoided.

A crane where the at least force-transmitting element is arranged parallel to the axis of rotation in relation to an erection plane oriented vertical to the horizontal axis guarantees that an exclusively vertically oriented force transmission is realised by means of the force-transmitting element. The axis of rotation is in particular oriented vertically. This means that the at least one force-transmitting element, and in particular also the device, are oriented vertically. This guarantees that the forces transmitted by means of the device are only vertically acting forces. The force flow through the device is advantageous. A torque directed around a horizontal plane in particular rules out that a transverse force places an additional and unintentional load on the rotary connection. It is also possible that the at least one force-transmitting element, and in particular the device, are substantially vertically oriented. Substantially vertical means that an angle of inclination in relation to the vertical is permitted, wherein this angle of inclination is at most 20°, in particular at most 15°, in particular at most 10°, in particular at most 7°, and especially at most 5°. Such an angle of inclination can, for example, result in that additional supports already provided are re-used, so that an exact vertical alignment of the force-transmitting element and the device is not guaranteed. The smaller the angle of inclination, i.e. the more the force-transmitting element is oriented in the vertical direction, the lower are the occurring transverse forces and torques that are to be avoided.

A crane where at least one connection element is envisaged, with which the device is connected with an under carriage and/or the upper carriage, enables an uncomplicated and fast connection of the force-transmitting element with the crane. In particular one connection element each is envisaged on the under carriage as well as on the upper carriage for arranging the device between the under carriage and the upper carriage. Connecting the device with the connection elements in particular is realised with a plug-in bolt connection. The connection elements are in particular permanently, i.e. non-disconnectably connected with the under carriage and/or the upper carriage. The connection element is in particular welded to the under carriage and/or to the upper carriage. The position of the device on the crane is defined by means of the connection elements.

A crane with an interim element that can be affixed to the under carriage, on which the at least one connection element is arranged, enables the at least one connection element to be fitted directly to the interim element. The at least one connection element is fitted directly to the under carriage. The interim element can be disconnectably or non-disconnectably fitted to the under carriage.

A support girder, which can advantageously be designed without support cylinders, in particular for cost reasons, can for example be used as an interim element. Such an interim element can be telescopically or foldably fitted to the under carriage. It is also possible to use a support element that is similar to a support girder as interim element, which is in particular permanently, in particular non-disconnectably connected with the under carriage, tensioned on one side as a cantilever. Alternatively the cantilever can also be arranged telescopically in an installation opening for a support girder envisaged for this purpose. The use of an interim element means that the radial distance of the connection element connected with the under carriage can be changed. In particular the radial distance of the connection element connected with the under carriage can be set identically to the radial distance of the connection element connected with the upper carriage in relation to the axis of rotation. In this way it is possible that the device is oriented vertically and transmits only vertically oriented forces between the upper carriage and the under carriage. This guarantees that no transverse force components can be transferred from the device to the rotary connection.

With a crane with an overload protection for detecting an overload on the device, a failure of the force-transmitting element due to overload is ruled out. The overload protection serves in particular for the additional monitoring of a load situation of the device. It is in particular possible in this way to recognise faults. Such faults can be load faults and/or application faults. The overload protection is in particular designed as a measuring device for detecting the force in the device and in particular for avoiding an overload. The overload protection in particular comprises a force sensor, which can for example be designed as an expansion measuring strip or a force capsule, or as a combination of both. Such a sensor is for example arranged on the device itself or for example in the area of a connection element. Other sensors are also possible in addition or alternatively, for detecting the current load condition of the rotary connection. Sensors for detecting the tension and/or deformation in the device are for example possible. In any case such a sensor is in signal connection with a controller. The controller is in particular connected with an output device, which can for example generate an optical and/or acoustic warning signal. The controller is additionally or alternatively connected with a drive device, with which the erection of the jib is realised. The controller is in particular designed in such a way that a load process is interrupted and/or active load relief, for example through lowering the jib against an erection rotation movement or through lowering a load, can be realised upon reaching the pre-determined load condition of the rotary connection.

A crane where the force-transmitting element is a tensile element for receiving tensile forces has comparatively high stability. The possible risk of buckling under a pressure load in particular is not given with the force-transmitting element as a tensile element. Several tensile elements connected with each other are also possible for forming the device. The device, which comprises at least one tensile element, is arranged on a side of the under carriage opposite the jib in relation to the axis of rotation of the rotary connection. The integrated tensile element in particular has an idle stroke in its unloaded, i.e. deformed condition.

A crane where the tensile element is rigidly designed as a traction rod, as a rod segment with at least one interim joint, as a pipe and/or as a metal sheet, is uncomplicated and easily affordable. The tensile element can additionally or alternatively be designed non-rigidly, in particular as a rope, chain and/or belt. It is also possible to combine rigid and non-rigid load elements in one device.

A crane where the tensile element is designed as a spring element can store an occurring load at least in part in a spring elastic way. The spring element can be coupled with at least one attenuator. This means that the tensile element has an attenuation function. The tensile element is suitable for compensating possibly occurring vibration between upper carriage and under carriage. The tensile element can for example be designed as a plate spring with attenuators, in particular in the form of polyurethane mouldings, in particular circular polyurethane discs. This embodiment enables large static and dynamic forces to be absorbed. The characteristics of a mechanical support element are advantageously combined with the characteristics of a mechanical spring element. The tensile element can also be designed as a layered rubber/metal spring. This embodiment represents a practically proven and cost effective design of the tensile element and favours a displacement of the upper carriage in relation to the under carriage. A load is in particular spring-cushioned, i.e. attenuated, and is not suddenly or jerkily transmitted from the upper carriage to the under carriage.

A crane where several tensile elements are combined into the device, wherein the tensile elements are in particular arranged in an assembly frame, simplifies the installation of the device.

A crane where the force-transmitting element is a pressure element enables the absorption of pressure forces. The pressure element is arranged adjacent to the jib between upper carriage and under carriage. The pressure element is arranged in relation to the erection plane between the axis of rotation of the rotary connection and the jib.

A crane where the device is displaceably guided along a holding track or a running track with an end facing the under carriage enables the crane to be used also with the device fitted, i.e. rotatable around the axis of rotation. The holding track or running track is in particular aligned concentrically to the axis of rotation of the rotary connection. It is therefore in particular not essential that the device is dismantled after an erection process in order to enable rotation between the upper carriage and the under carriage. The holding track or running track is in particular arranged directly on the under carriage. It is also possible that the holding track or running track is a disconnectable holding track or running track mounted on the under carriage, which is placed on the under carriage. The holding track or running track does not have to be designed as a continuous circular track. It is in particular possible that at least one, and in particular several holding tracks or running track segments, are envisaged separate from each other. The holding track or running track segment can have an opening angle of, for example, 5° to 45°, in particular of 15° to 30°, and in particular of approximately 20° in relation to an angle of rotation around the axis of rotation. These holding track or running track segments enable sectional, in particular comparatively small rotation movements between upper carriage and under carriage. Such rotation movements are for example necessary for reeving the lower flange.

A crane where a tensile element at an end facing the under carriage comprises at least one bearing body enables an improved, in particular friction reduced relative rotation movement between upper carriage and under carriage in an activated condition of the tensile element. The bearing body can be a glide element, in particular at least one glide coating and/or at least one guide element. The at least one glide element is in particular arranged circumferentially along the axis of rotation on a holding track, which can be designed as a glide track. The bearing body can also be a cylinder body, in particular a rotatably mounted wheel, a rotatably mounted roller and/or a rotatably mounted sphere. For large axial forces to be transmitted, cylinder bodies are particularly preferred over glide elements.

A crane with a pressure element as a pressure rod, comprising at least one cylinder body, in particular a caster, at an end facing the under carriage, circumferentially arranged along a running track of the axis of rotation, enables a rotating of the upper carriage in relation to the under carriage when the pressure element is fitted. The running track is in particular arranged directly on the under carriage.

It is a further object of the present invention to realise a force flow improvement in a crane in a flexible and uncomplicated way.

This object is solved by a device comprising at least one force-transmitting element, which is designed passively in such a way that it transmits forces one of from the upper carriage to the under carriage and vice versa when a pre-determined load condition of the rotary connection is reached, and the at least one force-transmitting element is unsuitable for producing a force onto at least one of the upper carriage and the under carriage by itself.

The fact that the device according to the invention completes a force transmission between the upper carriage and the under carriage of a crane with at least one force-transmitting element when a pre-determined load condition of the rotary connection is reached, guarantees the force flow improvement. An overloading of the rotary connection is avoided. As long as the pre-determined load condition of the rotary connection is not reached, the force-transmitting element remains passive, i.e. inactive. Forces occurring are, in particular exclusively, guided from the upper carriage to the under carriage by the rotary connection. This functionality is unlimited in such a load condition. At the same time the device according to the invention can be flexibly mounted on the crane, in particular directly on the upper carriage and on the under carriage. An existing crane can for example be upgraded with the device according to the invention. In this way it is possible to provide a crane with improved functionality without requiring considerable constructive changes on the crane, and in particular a larger rotary connection.

It is a further object of the present invention to improve the force flow in a crane during actuation of the same in such a way that the maximum forces transmittable between upper carriage and under carriage can be increased.

This object is solved by a method for deflecting forces on a crane, comprising the method steps provision of a crane according to the invention, loading the crane, transmission of forces from the upper carriage into the under carriage or vice versa by means of the rotary connection, additional transmission of forces from the upper carriage into the under carriage or vice versa by means of the at least one force-transmitting element when a pre-determined load condition of the rotary connection is reached.

According to the invention it has been recognised that the provision of the crane of the invention can control a load placed on the rotary connection of the crane in that the load is applied first, i.e. until the pre-determined load condition of the rotary connection is reached. As long as the pre-determined load condition is not reached, the at least one force-transmitting element is not under load. When the pre-determined load condition of the rotary connection is reached the force-transmitting element is also placed under load in that forces are transmitted directly from the upper carriage to the under carriage and vice versa. An additional load on the rotary connection is reduced. The load applied to the crane is transmitted by the load-transmitting element in this condition at least in part. Loading the crane or the rotary connection of the crane can result in said crane from a jib erection process. The erection of the jib is typically realised in that a free end of the jib is supported, in particular on a subfloor. An end of the jib lying opposite the free end is then mounted on the upper carriage and finally erected on the crane around a jib axis. A load placed on the rotary connection of the crane can also result from a stroke, namely a lifting of a load on the jib.

A method wherein further method steps, in particular independently from each other, are initiated depending on a detected load condition, enables a simplified handling of the crane for an user and in particular a targeted monitoring during operation of the crane. The method primarily serves for increasing the transmittable forces between the upper carriage and the under carriage of the crane. In addition, the method enables the operation of the crane with guaranteed operation safety. The risk of an accident is reduced. In particular it is possible to actively interfere in the operation of the crane in order to avoid an overload. Such a method enables preventative measures for accident prevention. Such a method can comprise the further methods steps detecting a load condition of the rotary connection by means of at least one sensor, and/or balancing the detected load condition of the rotary connection with the pre-determined load condition. In particular at least one of the following method steps is carried out when the detected load condition of the rotary connection reaches the pre-determined load condition, namely initiating a warning/alarm signal and transmitting the warning/alarm signal to an output device, and/or interrupting a loading process of the crane, and/or active load relief of the crane, in particular by lowering a jib against an erection rotation movement and/or by lowering a load.

The further advantages of the method substantially equal the advantages of the crane, to which we herewith refer.

Embodiment examples of the invention will be explained in more detail below with reference to the drawings.

DESCRIPTION OF THE PREFERRED EMBODIMENTS

Figure 1:
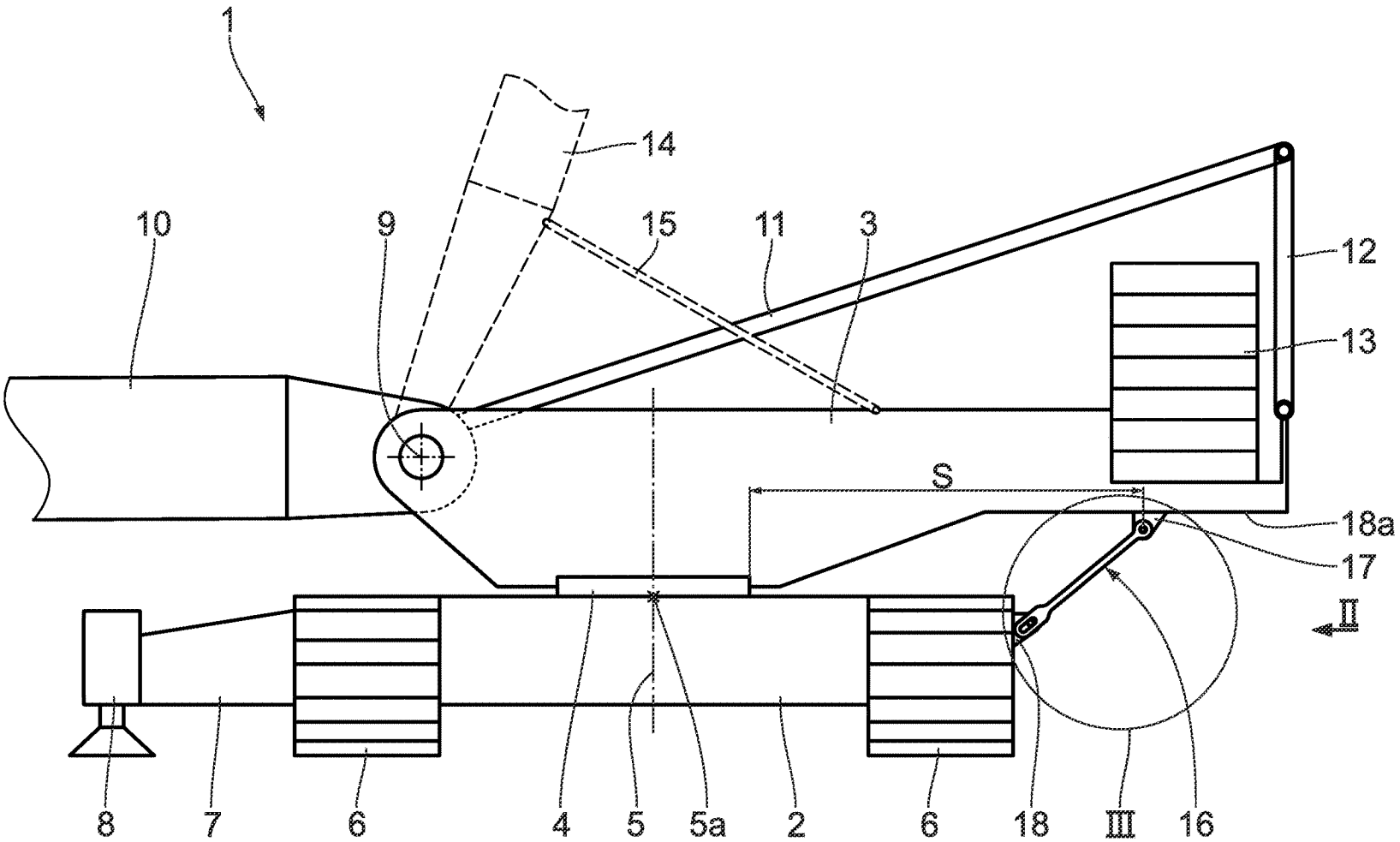
FIG. 1 shows a side view of a crane according to the invention with a device designed as a traction rod.
Figure 2:
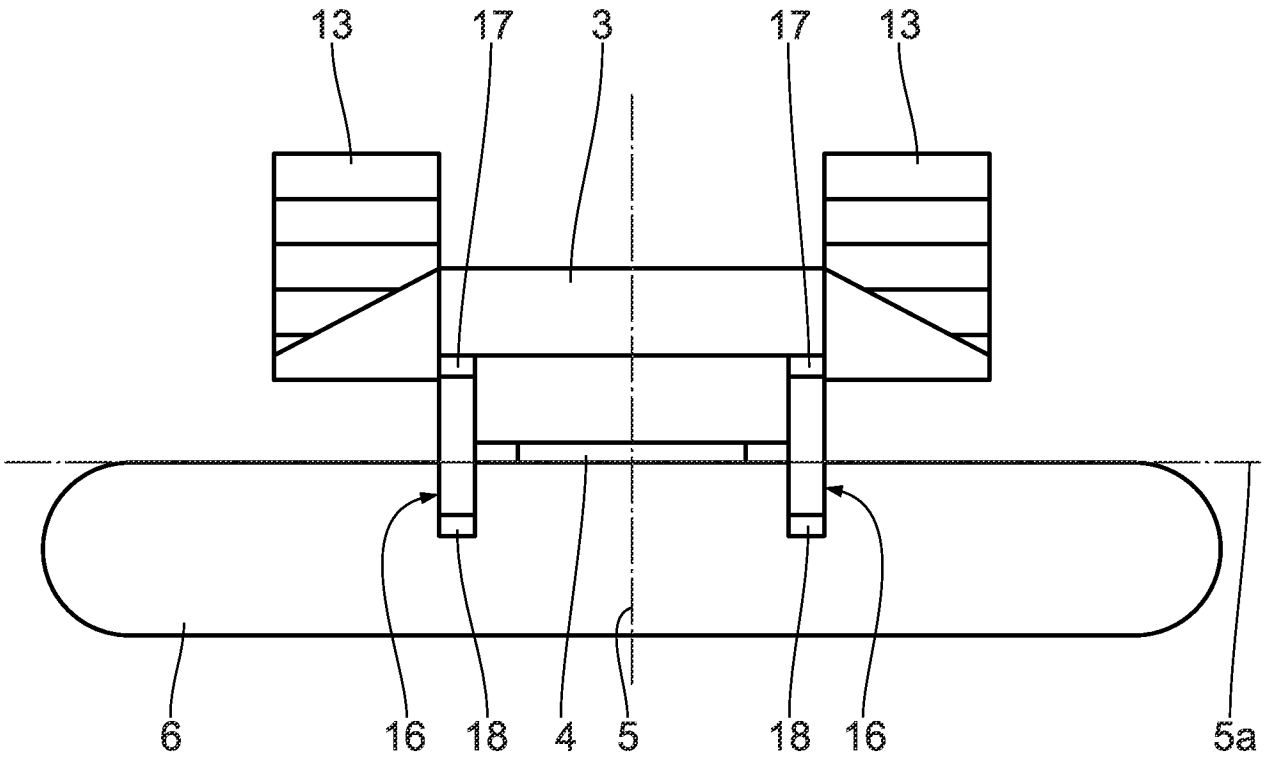
FIG. 2 shows a side view of the crane of FIG. 1 in relation to an axis of rotation of a rotary connection rotated by 90°.
Figure 3:
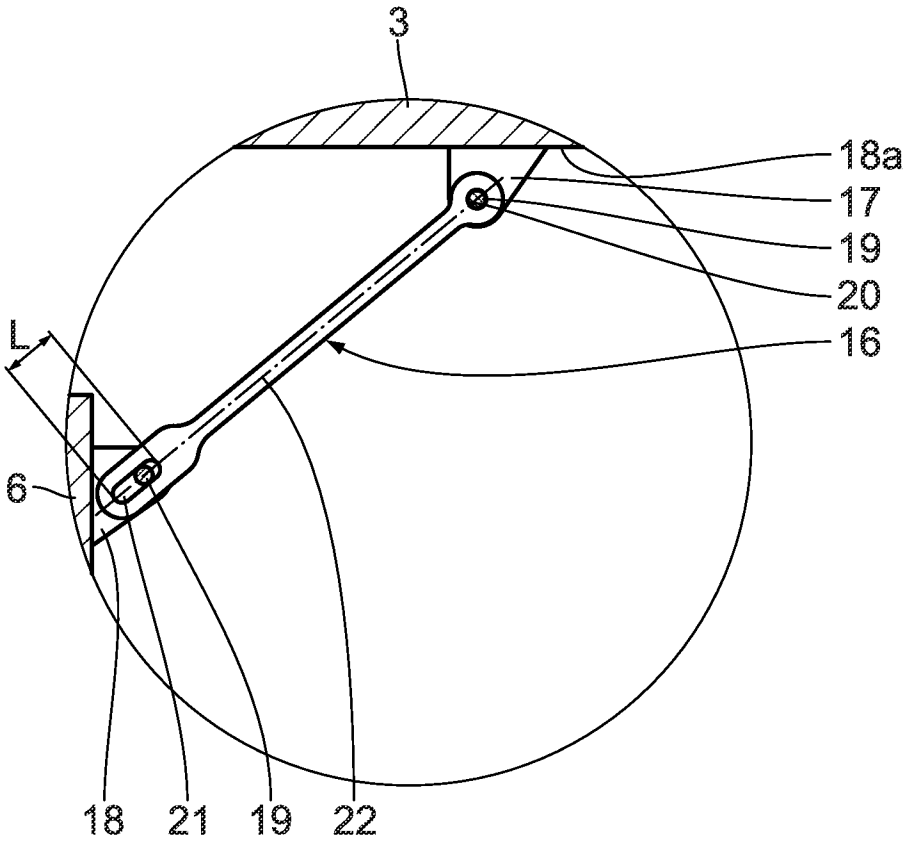
FIG. 3 shows an enlarged detail view of detail III of FIG. 1.

An embodiment shown in FIGS. 1 to 3 concerns a crane 1 with an under carriage 2, an upper carriage 3 and a rotary connection 4, by means of which the upper carriage 3 is rotatably connected around a vertical axis of rotation 5 with the under carriage 2. The rotary connection 4 comprises several rollers, not shown, which roll on a swivel. The rotary connection 4 is a roller bearing slew ring. According to the embodiment shown, frame girders 6 are arranged on the under carriage 2. The crane 1 is a crawler crane. It is also possible to design the crane 1 as a mobile crane or a pedestal crane. A mobile crane is in particular equipped with rubber tyres. A pedestal crane is generally supported on several plinths or pedestals. A pedestal crane is not driveable.

Two support girders 7 are envisaged on the sides of the frame girder 6 illustrated on the left in FIG. 1 on the under carriage 2, comprising a support cylinder 8 and/or pressure spindles at a free end. The support girder 7 with the support cylinder 8 fitted to the same enable an additional support of the crane 1. This means that the footprint, the so-called support base of the crane, is enlarged. In this way the stability of the crane against unintended tilting is reduced. The support girders 7 with the support cylinders 8 fitted to the same can each be fitted to the frame girder 6 telescopically and/or removably and/or foldable around a, for example, horizontal or vertical folding axis.

A jib 10 that can be erected around a horizontal jib axis 9 is linked to the upper carriage 3. The pivot movement of the jib 10 around the horizontal jib axis 9 defines an erection plane. The erection plane is a vertical plane, oriented vertically to the jib axis 9. The erection plane is parallel to the drawing plane of FIG. 1. The jib 10 is connected with an erection trestle 11 with a rope reeving 12 in the form of a retractable rope 12 for erecting the same. A support trestle, not shown, can also be used for erecting the jib 10 instead of the erection trestle 11. The rope reeving 12 is arranged above the trestle. It is also feasible to combine the erection trestle 11 with a support trestle, wherein the rope reeving 12 is then arranged between the erection trestle 11 and the support trestle. The erection trestle 11 can be fitted to the jib 10, and in particular to the jib head, i.e. to the upper, free end of the jib 10, by means of additional holding elements, in particular by means of holding rods and/or holding ropes whilst erecting the jib 10. The retractable rope is arranged on the back of the upper carriage 3 opposite the jib axis 9. Several counterweight elements 13 stacked on top of each other are envisaged on the upper carriage 3. The counterweight elements 13 form an upper carriage counterweight for preventing an inclination of the crane 1, in particular the upper carriage 3, in the direction of the jib 10. Such an inclination can result during the erection of the jib 10 and/or during operation of the crane 1 when a load is attached.

An additional super lift device comprising a super lift mast 14 and a support cylinder 15 that supports the super lift mast 14 against the upper carriage 3 can be envisaged according to the embodiment shown here. The superlift mast 14 is a counter jib to the jib 10. The jib 10 is the main jib of the crane 1. The super lift mast 14 can comprise an additional counterweight, not illustrated here.

A device with a force-transmitting element 16 in the form of a traction rod is arranged on a side of the upper carriage 3 opposite the jib 10. The traction rod 16 represents a tensile element that is rigid. The device is connected with the upper carriage 3 with a first end and with the under carriage 2 with a second end. The device serves for taking the load off the rotary connection 4 in that vertically acting forces are transmitted from the upper carriage 3 into the under carriage 2 at least in part when the jib 10 is erected. The device is connected with the upper carriage 3 by means of an upper carriage connection element 17. The upper carriage connection element 17 is in particular permanently connected with, in particular welded to an underside 18*a* of the upper carriage 3. The upper connection element 17 can also be disconnectably connected with, in particular screwed to the upper carriage 3. The upper carriage connection element 17 is a connection eye, to which the device is bolted.

The device is connected with the under carriage 2 by means of an under carriage connection element 18. The under carriage connection element 18 is permanently fitted at the side of, in particular welded to the frame girder 6 illustrated on the right of FIG. 1 according to the embodiment shown. The under carriage connection element 18 can also be disconnectably arranged on the support girder 6, in particular screwed to the same.

The device is arranged on the erection plane in relation to the axis of rotation 5 opposite the jib 10. This means that an erection load of the jib 10 will lead to a deformation and/or a tilting of the upper carriage 3 around a horizontal axis 5*a* as a consequence of its own weight during erection. The deformation and/or tilting of the upper carriage 3 causes a load to be placed on the upper carriage 3, and in particular on the rotary connection 4 arranged between the upper carriage 3 and the under carriage 2. The load is absorbed by the rotary connection 4. The load absorbed by the rotary connection 4 can be tolerated. As soon as an adjustable load limit is reached, for example following a maximum deformation and/or tilting of the upper carriage 3, an additional load increase is prevented by a geometric limitation of the tilting of the upper carriage 3. A load increase will therefore not lead to the upper carriage 3 tilting further around the horizontal axis of rotation 5*a*. Further load forces are transmitted from the upper carriage 3 directly into the under carriage 2 by the device. The load is taken off the rotary connection 4 by the load removal effect of the device.

According to the side view in FIG. 2 it is clear that the device comprises two force-transmitting elements 16 arranged on a force transmitting plane, which is arranged symmetrical to the axis of rotation 5, identically to the drawing plane in FIG. 2. This means that a vertical distance of the force-transmitting elements 16 from the axis of rotation 5 is identical. The force transmission plane is oriented vertical to the erection plane. At the same time it is clear from FIG. 2 that the counterweight elements 13 lie on two identical stacks on the upper carriage 3, also symmetrical to the axis of rotation 5.

The force-transmitting element will be described in more detail hereafter with reference to FIG. 3. The force-transmitting element is mounted on the under carriage 2 to swivel around the support girder 6 on the upper carriage 3 as well as a respective horizontal axis 5*a*. This enables the force-transmitting element 16 to carry out a relative movement between the upper carriage 3 and the under carriage 2. The force-transmitting element 16 is fitted to the upper carriage connection element 17 by means of a bolt 19. The force-transmitting element 16 comprises a bolt opening 20 corresponding with the bolt 19 for this. The connection of the force-transmitting element 16 with the under carriage connection element 18 is realised with the bolt 19 arranged in an oblong hole 21. The oblong hole 21 has a width that substantially equals the diameter of the bolt 19. It is possible to size the diameter of the bolt 19 in such a way that it is a little larger than the width of the oblong hole 21. The bolt 19 is therefore pre-tensioned in the oblong hole 21. A displacement of the force-transmitting element 16 in relation to the under carriage 2 will effect a friction force between the oblong hole 21 of the force-transmitting element 16 and the bolt 19. In particular the diameter of the bolt 19 is at least 101% of the width of the oblong hole 21, in particular at least 102% of the width of the oblong hole, and in particular at least 105% of the width of the oblong hole 21. A screw connection can also be used instead of the bolt 19, wherein the force-transmitting element 16 can be pre-tensioned, in particular in the area of the oblong hole 21 between screw head and nut, for generating a desired friction effect between the screw connection and the force-transmitting element. This means that the force-transmitting element 16 can be displaced, in particular guided on the bolt 19 along a virtual line 22 connecting the two bolts. The length L of the oblong hole 21 stipulates a maximum incline of the upper carriage 3 tolerated by the device without forces being transmitted by the device from the upper carriage 3 to the under carriage 2. The length L of the oblong hole 21 and the diameter of the bolt 19 define a geometric play. The geometric play is exhausted when the bolt 19 abuts against one end of the oblong hole 21. The device is in particular in a non-load condition in the load situation shown in FIG. 3. This means that a current load condition of the rotary connection 4 is lower than a pre-set load condition of the rotary connection. Changing the length L of the oblong hole 21 therefore pre-determines the load dimension that can be tolerated in the form of a maximum admissible deformation. The longer length L, the greater the maximum admissible deformation, i.e. the pre-set load condition of the rotary connection 4. The pre-set deformation is also designated as geometric play or idle stroke. It is also possible to envisage an oblong hole according to oblong hole 21 with an identical or different length instead of the bolt opening 20. It is also feasible that an oblong hole is envisaged only at the end of the force-transmitting element 16 facing the upper carriage connection element 17, and a round bolt opening at the end of the force-transmitting element 16 facing the under carriage connection element 18.

Fitting the device to the crane 1 is uncomplicated. Thanks to the design of the force-transmitting elements 16 a tolerance window each is defined with the oblong hole 21, which enables a fast fitting without problem. Dimensional deviations, for example as a consequence of a changed counterweight arrangement on the under carriage 2, in particular will not lead to the distances of the bolts 19 not agreeing with the bore distances of the bolt opening 20 and the oblong hole 21.

The force-transmitting element 16 according to the embodiment example shown is a solid traction rod. It is also possible to design the force-transmitting element 16 as a tubular rod of a multi-tab sheet metal construction, so that several metal sheets are arranged next to each other along the bolt axis. It is also possible to connect several traction rods with each other to form a device 16 that is arranged between the two bolts 19.

A vertical distance S of a force induction point on the upper carriage 3 to an outer annular edge of the rotary connection 4 is identified with S in FIG. 1. The force induction point on the upper carriage 3 is defined by the bolt 19 between the upper carriage connection element 17 and the force-transmitting element 16.

The function of the crane 1 according to the invention with the device will be explained in more detail hereafter with reference to a method for erecting the jib 10. Based on the crane 1 shown in FIGS. 1 to 3, on which the jib 10 is initially not arranged, a free end of the jib 10, not shown in the Figures, is supported. This support can for example be realised in that the jib 10 is positioned in the ground with the free end. The jib 10 is then mounted, in particular bolted, to swivel around the jib axis 9 on the under carriage 2 with the end opposite the free end. A erecting of the jib 10 around the jib axis by actuating the rope reeving 12 then follows, which applies an erection force to the jib 10 by means of the erection trestle 11. As soon as the jib 10 is no longer supported, a weight force generated by the jib 10 applies a torque to the rotary connection 4. This can lead to the upper carriage 3 inclining towards the horizontal axis 5*a* on the under carriage 2. The inclination results in direction of the jib 10, according to FIG. 1 therefore towards the bottom left. By linking the force-transmitting element 16 with the under carriage connection element via the oblong hole 21, a pre-determinable angle of inclination is tolerated by the device. The maximum tolerable inclination is reached when the force-transmitting element 16 abuts against the bolt 19 with the left end of the oblong hole 21 illustrated in FIG. 3. A further free displacement of the upper carriage 3 in relation to the under carriage 2 is then no longer possible. In this condition a pre-determined load condition of the rotary connection 4 is reached. Load is taken off the rotary connection 4 in that a force is transmitted from the up per carriage 3 to the under carriage 2 via the device. This pre-determined load condition of the rotary connection 4 can be set by varying the length L of the oblong hole 21. The device is a passive device. A force flow occurs only when an external load reached a pre-determined limit value, in particular during the erection of a long jib.

A further embodiment of the invention is illustrated in FIGS. 4A, 4B, 5A and 5B. Components that equal those already explained above with reference to FIGS. 1 to 3 bear the same reference numbers and will not be discussed in detail again.

The major difference in the crane of the shown embodiment is the arrangement of the device on the crane 1. The device itself is designed as a traction rod. The under carriage connection element 18 of the embodiment shown is not directly fitted to the frame girder 6, but to an interim element 23 fitted to the frame girder 6. The interim element 23 can be designed identically to the support girder 7. The under carriage connection element 18 is aligned in relation to the upper carriage connection element 17 in such a way that the virtual line 22 between the bolts 19 is oriented vertically. This means that the device is arranged parallel to the axis of rotation 5 in relation to the erection plane, which is parallel to the drawing plane according to FIGS. 4A and 5A.

Compared to the first embodiment the vertical distance of the force application point on the upper carriage 3 opposite the rotary connection can be enlarged with the crane with the interim element 23 in such a way that the interim element 23 is extended. With a corresponding displacement of the upper carriage connection element 17 it can still be guaranteed that the virtual line 22 is oriented vertically. A displacement of the upper carriage connection element 17 will however merely effect a reduction of the angle of inclination of the virtual line 22 in relation to the horizontal with the crane according to the first embodiment. The flatter the angle of inclination of the virtual line 22, the more unfavourable the load situation for the device itself, designed for transmitting vertical forces, will be.

Figure 4A:
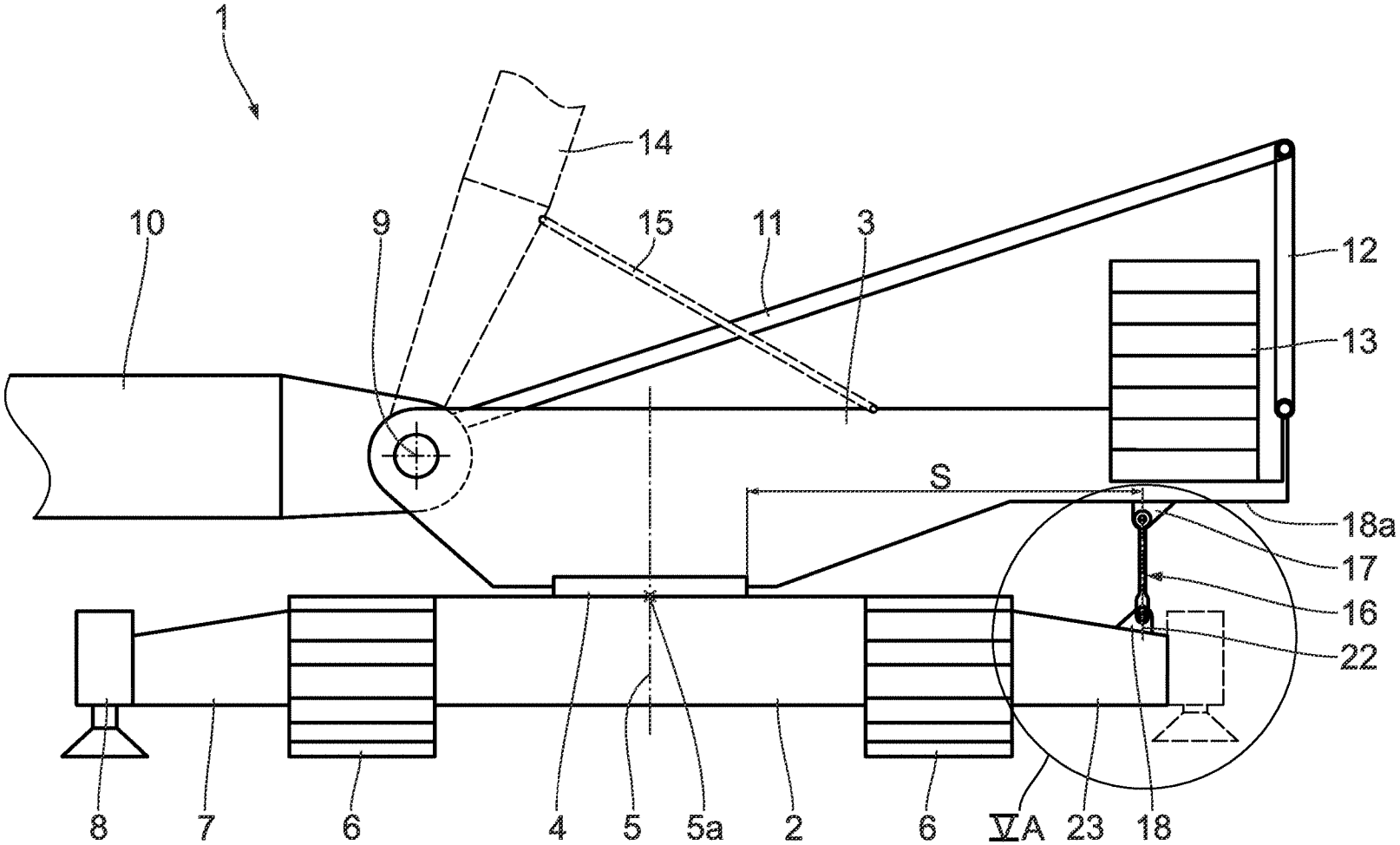
FIG. 4A shows a side view corresponding to that of FIG. 1 of a further embodiment.
Figure 4B:
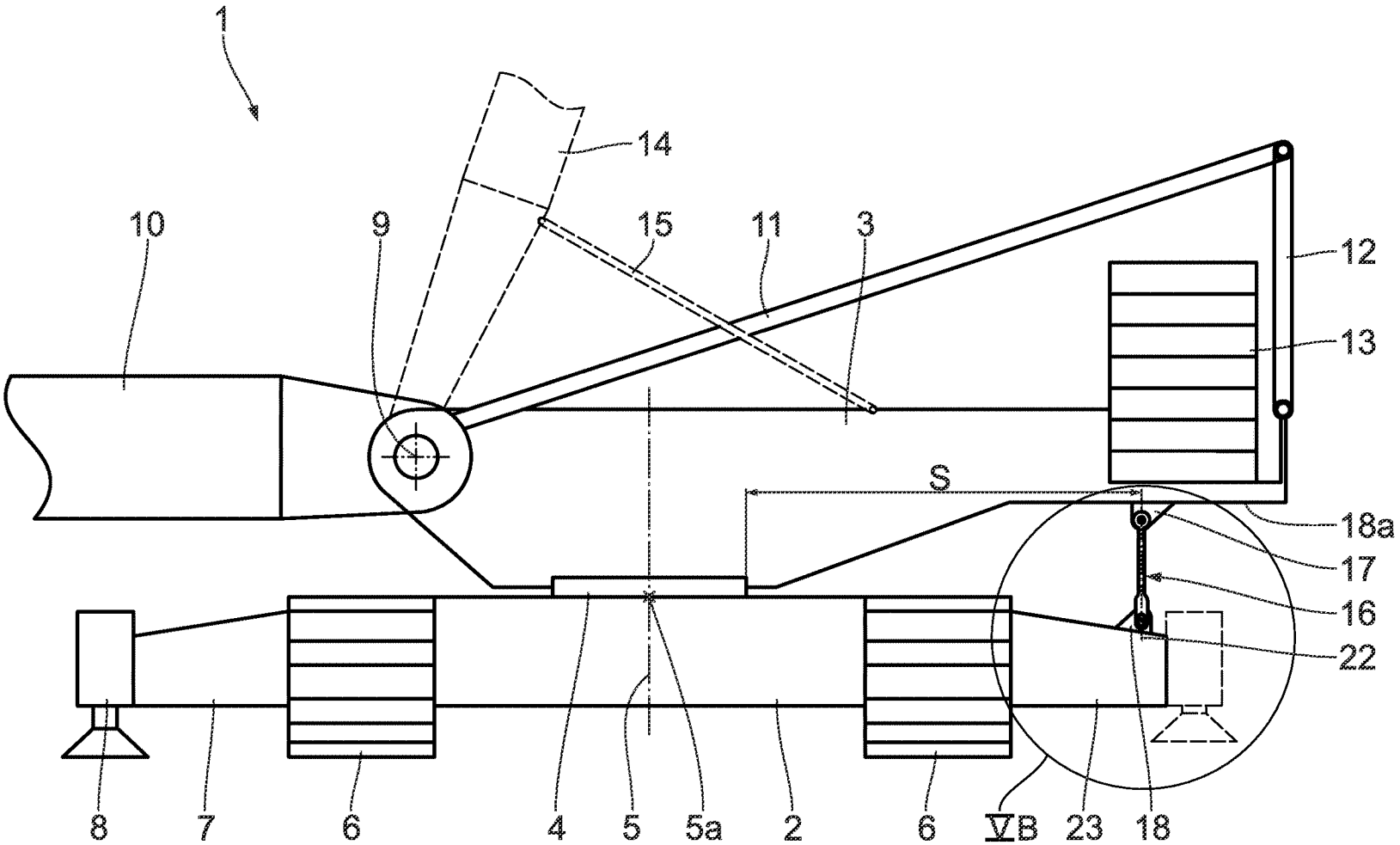
FIG. 4B shows a view corresponding to that of FIG. 4A in an unloaded condition.
Figure 5B:
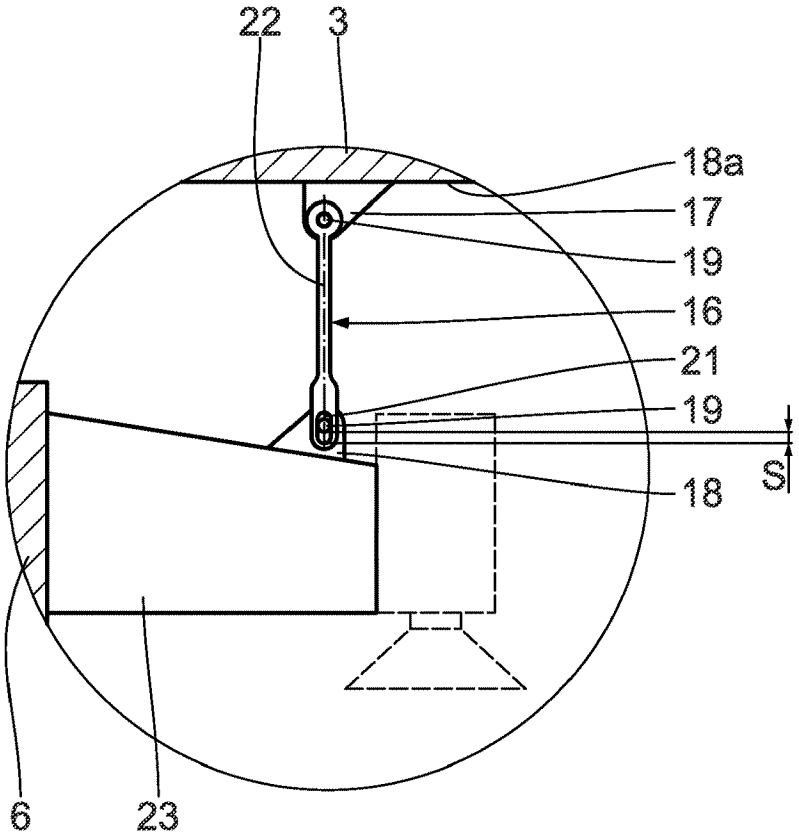
FIG. 5B shows a view corresponding to that of FIG. 5A in a discharged condition.
Figure 5A:
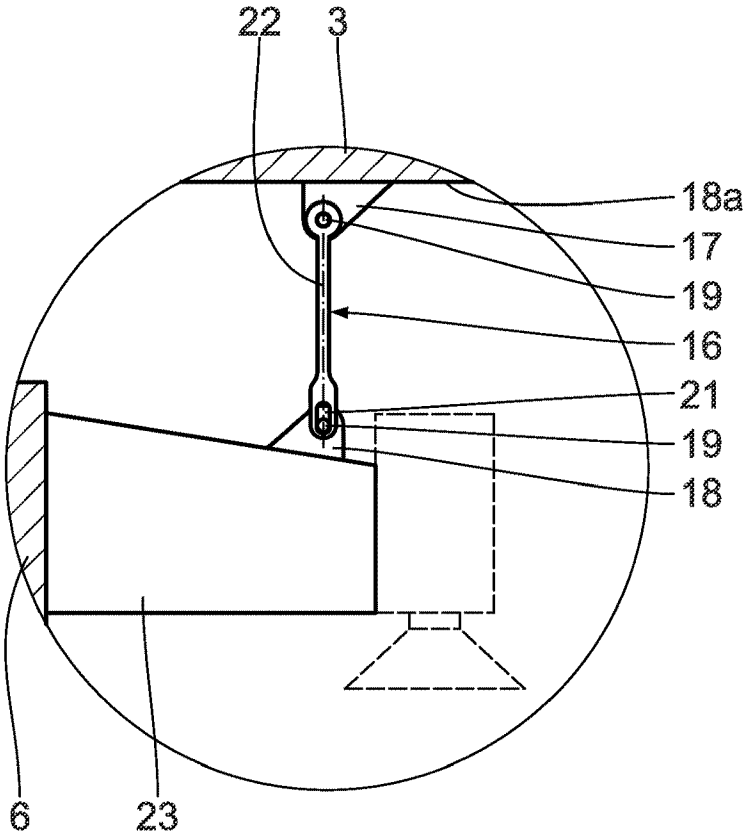
FIG. 5A shows an enlarged detail view of details V of FIG. 4A.

In an unloaded, i.e. discharged condition of the crane according to FIG. 4B, 5B the force-transmitting element is unloaded. The bolt 19 is arranged inside, in particular not at the end of the oblong hole 21. A distance S of the bolt 19 from the bottom of the oblong hole 21 shown in FIG. 5B corresponds to the play of this embodiment. When the crane, in particular the upper carriage 3, in particular in the area of the jib axis 9, is charged a gravity aiming vertically downwards acts upon the jib axis 9 on the upper carriage 3, whereby a moment of force is caused around the horizontal axis 5*a* in the anticlockwise direction according to FIG. 4A. The rearward arranged force-transmitting element 16 is pulled upwards with the upper-carriage connection element 17 until the bolt 19 is arranged on the bottom of the oblong hole 21. The charged arrangement is shown in FIG. 4A, 5A. For display reasons the upper carriage 3, in the charged condition according to FIG. 4A, 5A, is not shown inclined compared to the under carriage 2.

Figure 6B:
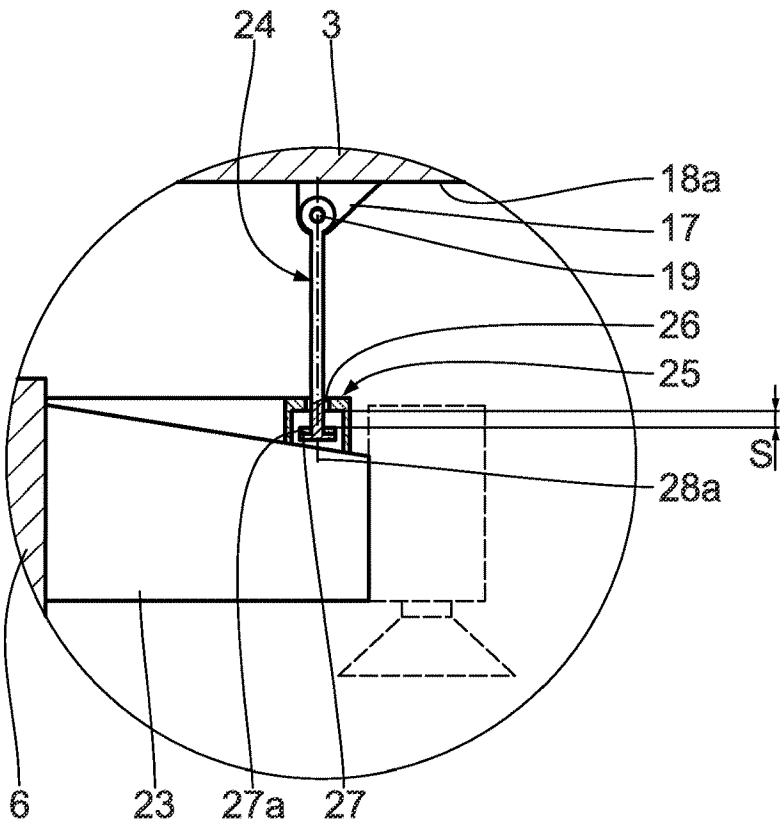
FIG. 6B shows a detail view corresponding to that of FIG. 6A in a discharged condition.
Figure 6A:
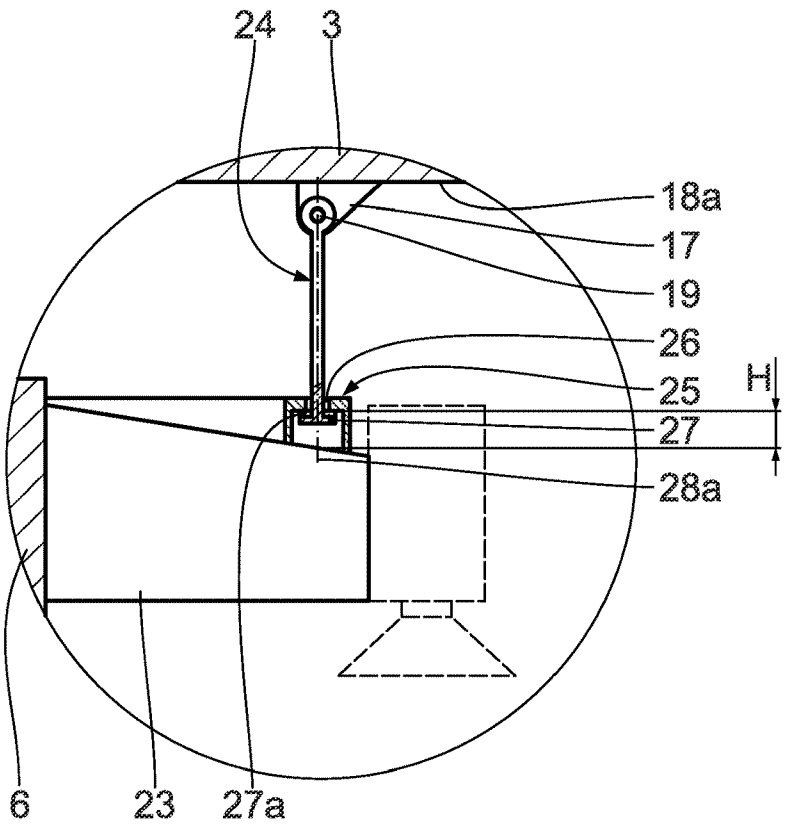
FIG. 6A shows a detail view corresponding to that of FIG. 5A of a further embodiment of the crane.

FIGS. 6A and 6B show further embodiments of the crane 1. Components that equal those explained above with reference to FIGS. 1 to 5B are identified with the same reference number and will not be discussed again in detail.

One major difference with the crane 1 is the design of the device. According to the previous embodiment the device comprises a force-transmitting element 24 designed as a traction rod and bolted to the upper carriage connection element 17 by means of a bolt 19. A running track 25 is envisaged on the interim element 23, along which the device can be guided and displaced. The running track 25 is continuously circular or made of at least one or several individual interrupted circular segment sections, and is arranged concentrically to the axis of rotation 5. The running track 25 is designed as a retention track, comprising a circular slot opening 26 facing the upper carriage 3. The running track 25 is a holding track. The force-transmitting element 24 is guided through the circular slot opening 26. The force-transmitting element 24 comprises a plate section 27 at the lower end opposite the bolt opening 20, which is greater than a clear width of the circular slot opening 26. The plate section 27 can be designed rectangular, square or circular. The plate section 27 comprises glide elements 27*a* on the top facing the upper carriage 3, which can abut against an underside of the running track 25 facing the plate section 27 for glide displacement. The glide elements 27*a* abut against the bottom side of the running track 25 when the maximum admissible critical deformation is reached. This condition is shown in FIG. 6A. In this charged condition a rotation of the upper carriage 3 compared to the under carriage 2 is still possible. This guarantees that a gliding rotational displacement between the upper carriage 3 and the under carriage 2 is admissible even if a maximum admissible load condition is reached and the plate section 27 abuts against the underside of the running track 25. It is also possible to manufacture the complete plate section 27 from a glide material. Separate glide surfaces such as for example glide coatings and/or glide layers can then be omitted. In an unloaded condition the force-transmitting element 24 according to FIG. 6B with the plate section 27 is arranged at a distance from the bottom of the running track 25. The glide elements 2*a* do not abut against the bottom of the running track 25. The distance S of the glide elements 27*a* from the bottom of the running track 25 along the vertical load relief axis 28*a* defines the play, i.e. the idle stroke, of this embodiment. The adjustability of the device results from the free stroke height H of the force-transmitting element 24 in the running track 25 along the vertical load relief axis 28*a* stipulated by the device.

The fact that the device can be guided and displaced along a concentric circular path in relation to the axis of rotation 5 makes it possible that the crane 1 can be operated whilst the device is fitted. It is in particular possible that the crane 1 carries out a rotation movement with the upper carriage 3 in relation to the under carriage 2 when the device 24 is mounted between upper carriage 3 and under carriage 2. The device enables a relative rotation movement between upper carriage 3 and under carriage 2 around the axis of rotation 5.

Figure 7B:
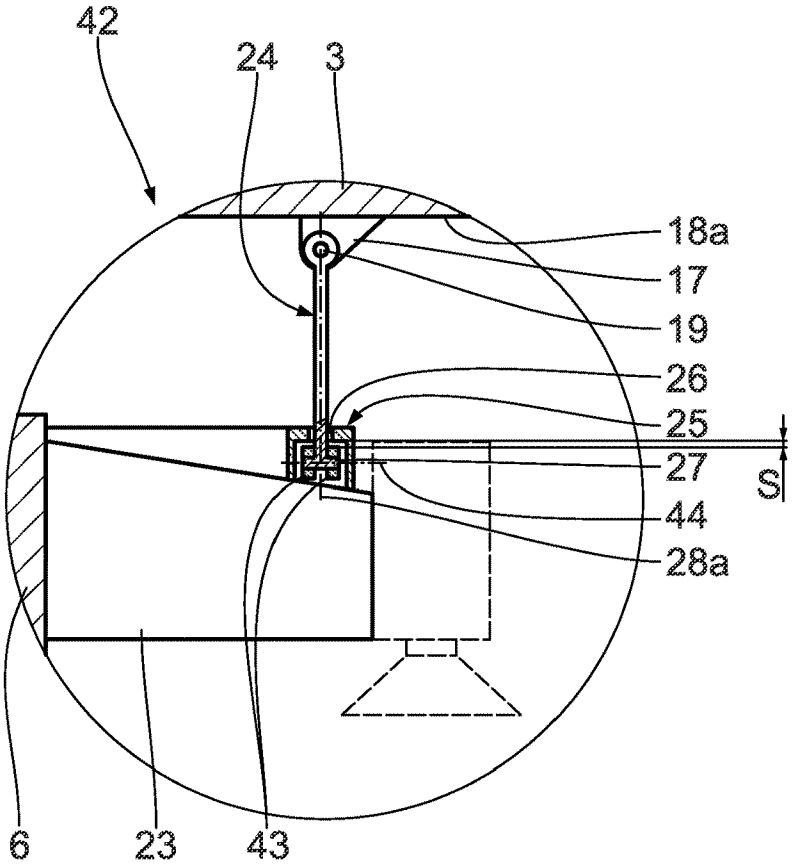
FIG. 7B shows a view corresponding to that of FIG. 7A in a discharged condition.
Figure 7A:
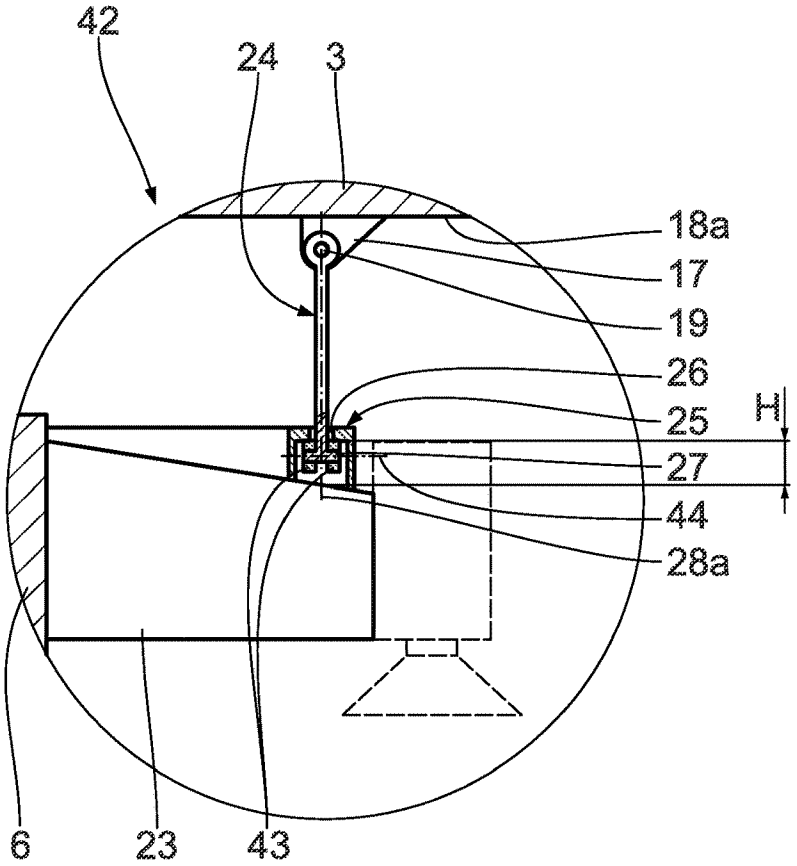
FIG. 7A shows a detail view corresponding to that of FIG. 6A of a further embodiment of the crane.

FIGS. 7A and 7B show a further design of the crane 1. Components that equal those explained above with reference to FIGS. 1 to 6B are identified with the same reference number and will not be discussed again in detail.

The crane 1 comprises a running track 25, along which the device can be guided and displaced. The difference from the embodiment described above is that not a glide element but at least one cylinder body 43 is arranged on the plate section 27. According to the embodiment shown two cylinder bodies 43 are mounted to rotate around a substantially horizontally oriented axis 44. According to the embodiment shown two bearing bodies 43 are envisaged as rotatably mounted wheels. The bearing bodies 43 are arranged symmetrical to the load relief axis 28*a*. The axis of rotation 44 is in particular oriented vertically to the load relief axis 28*a*. The bearing bodies 43 can also be designed in another way. More than two bearing bodies 43 are also feasible. The plate section 27 is designed like a bridge in with cylinder bodies 43 in the embodiment shown. The force-transmitting element 24 is substantially T-shaped.

An unloaded arrangement of the force-transmitting element 24 is shown in FIG. 7B. In this arrangement the cylinder bodies 43 are arranged with the distance S to the running track 25. In a loaded arrangement the cylinder bodies 43 unroll on the bottom of the running track 25.

Figure 8:
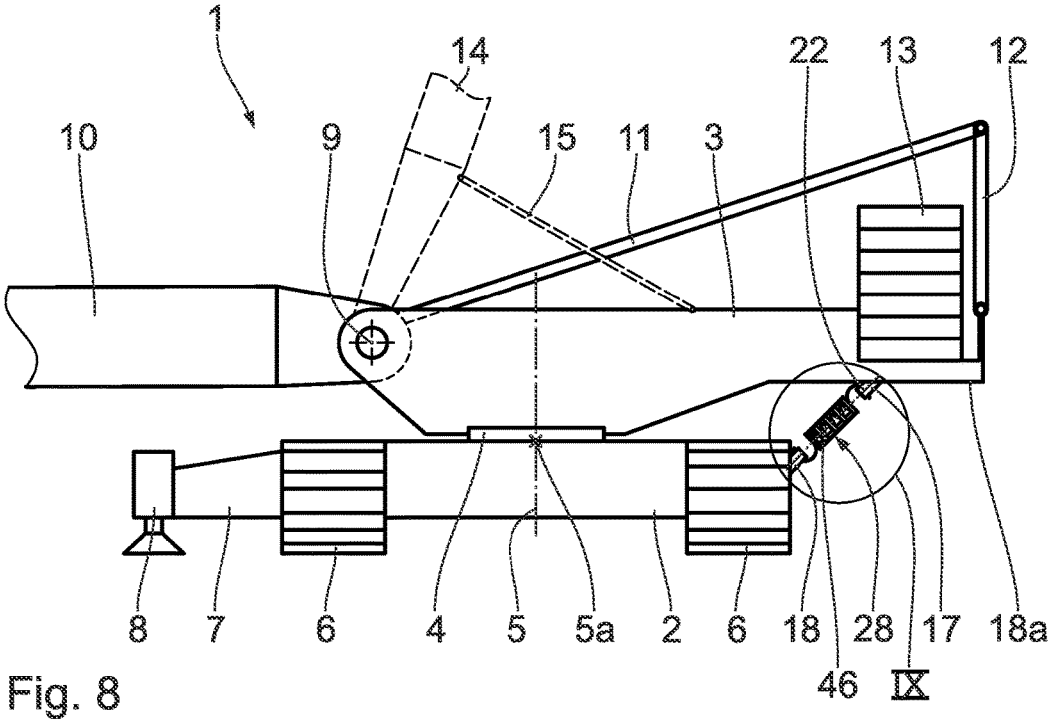
FIG. 8 shows a side view corresponding to that of FIG. 1 of a further embodiment of the crane with a spring element as the device.
Figure 9:
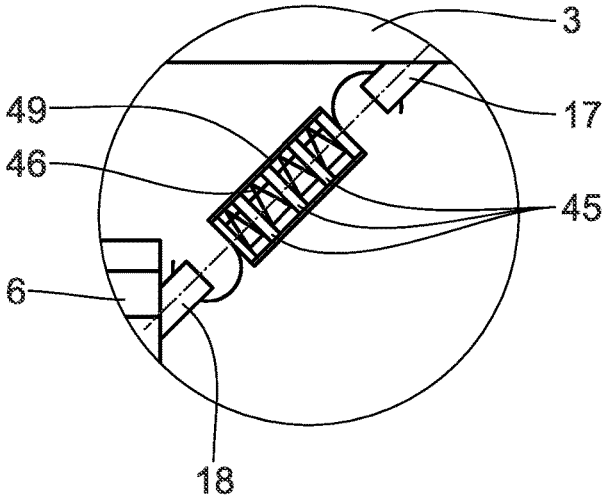
FIG. 9 shows an enlarged detail view of detail IX in FIG. 8.

FIGS. 8 and 9 show a further embodiment of a crane 1. Components that equal those explained above with reference to FIGS. 1 to 7 are identified with the same reference number and will not be discussed again in detail.

The major difference compared to the first embodiment is the design of the device with the force-transmitting element 28 as a spring element 46, which is fitted to the connection elements 17, 18.

The spring element 46 is illustrated purely schematically for clarity reasons in FIG. 8. The specific design is shown in the detail view according to FIG. 9. The spring element 46 is designed as a plate spring with several plate sections arranged behind each other along the longitudinal spring axis. An attenuator 45 each, designed as a polyurethane moulding, in particular as an annual polyurethane disc, is arranged between two plate sections arranged along the longitudinal spring axis according to the embodiment shown. The plate spring 46 and the attenuators 45 are arranged in a sleeve 49 and held in the same. The attenuators 45 prevent that an unintended vibration condition that can lead to dynamic instability can occur between under carriage 2 and upper carriage 3. This means that the plate sections of the spring element 46 and the individual attenuators 45 are arranged in between behind one another along the longitudinal spring axis, i.e. in series.

Figure 10:
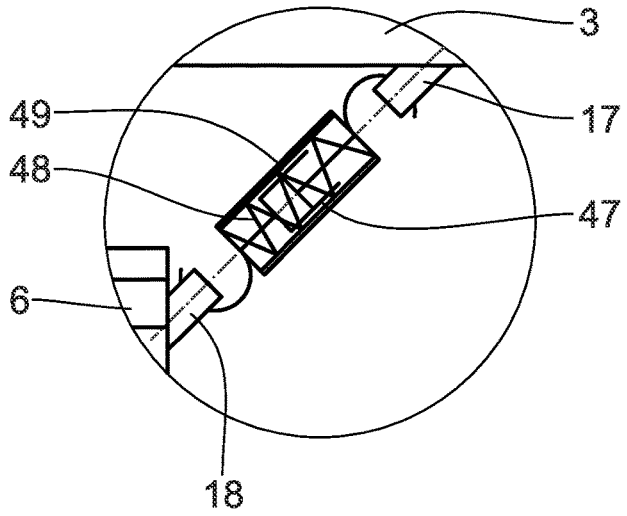
FIG. 10 shows a detail view corresponding to that of FIG. 9 of a further embodiment of the spring element.

FIG. 10 shows a further embodiment of a crane 1. Components that equal those explained above with reference to FIGS. 1 to 9 are identified with the same reference number and will not be discussed again in detail.

The major difference compared to the previous embodiment is that an attenuator 47 is envisaged, arranged parallel to the spring element 48 in the sleeve 49. The spring element 48 is for example designed as a helical spring. The attenuator 47 is for example designed as a hydraulic or pneumatic attenuator, in particular as a piston cylinder unit, and is arranged inside a cylinder-shaped hollow formed by the helical spring.

Figure 11:
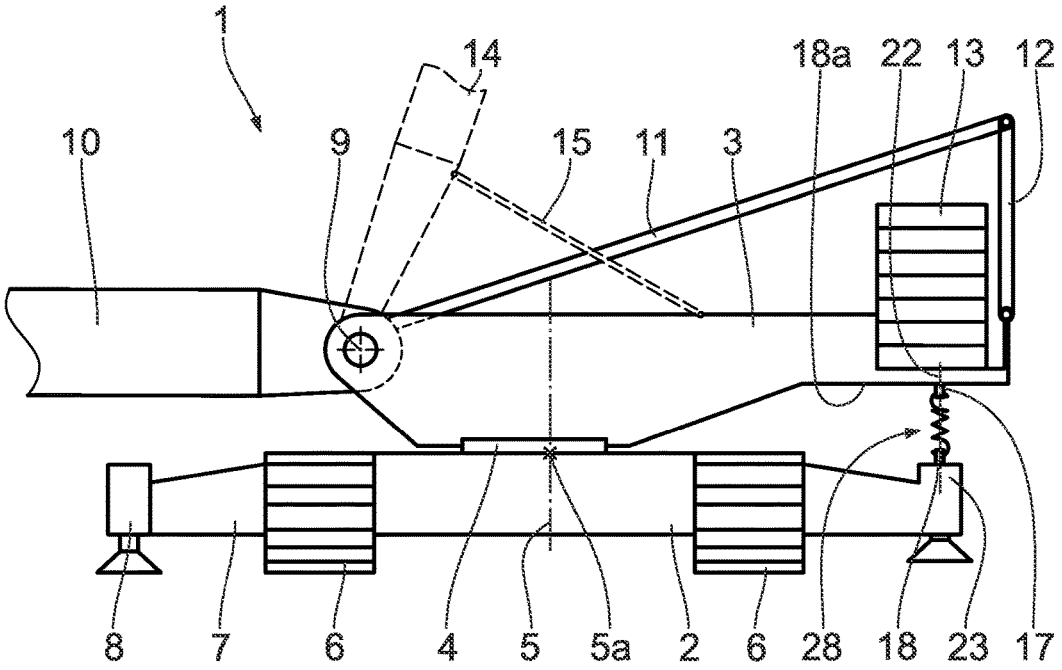
FIG. 11 shows a side view corresponding to that of FIG. 4A of a further embodiment of a crane with a spring element as the device.

FIG. 11 shows a further design of a crane 1. Components that equal those explained above with reference to FIGS. 1 to 10 are identified with the same reference number and will not be discussed again in detail.

According to the embodiment shown the device comprises a force-transmitting element 28 designed as a spring element, wherein the under carriage connection element 18 is arranged on the interim element 23 in such a way that the connection line 22 between the connection elements 17, 18 is oriented vertically.

Figure 12:
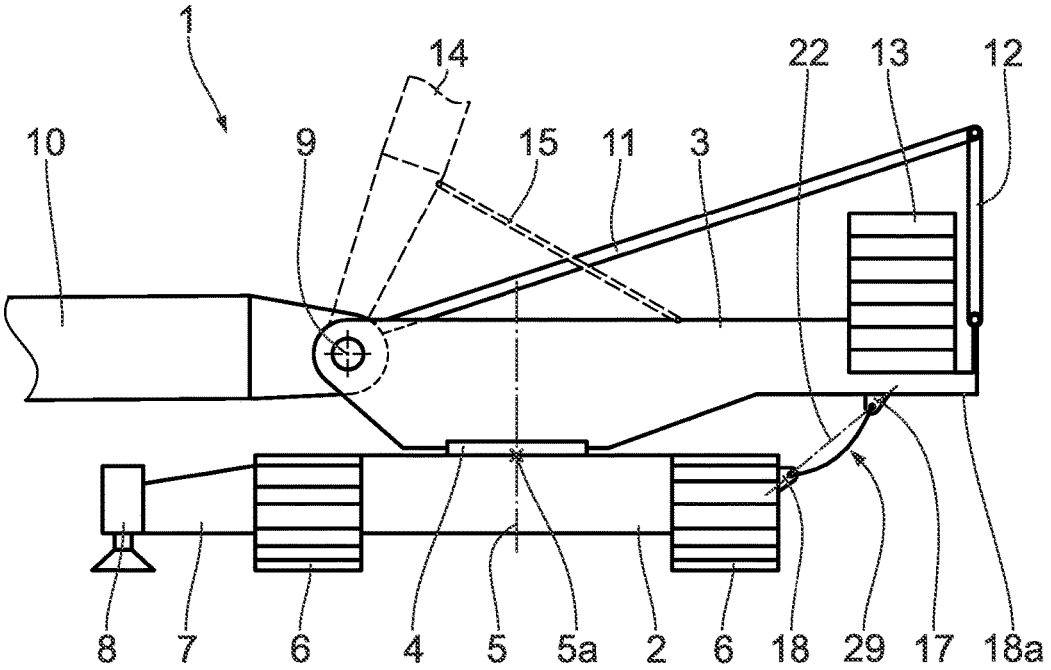
FIG. 12 shows a side view corresponding to that of FIG. 1 of a further embodiment of a crane with a rope as the device.

FIG. 12 shows a further embodiment of a crane 1. Components that equal those explained above with reference to FIGS. 1 to 11 are identified with the same reference number and will not be discussed again in detail.

The major difference is that the device comprises a force-transmitting element 29 that is designed as a rope and connects the two connection elements 17, 18 with each other. In the load-free situation of FIG. 9 the rope 29 is slack. As soon as a maximum admissible load condition is reached the rope 29 becomes taut and is then parallel to the virtual connection line 22 between the connection points of the connection elements 17, 18. A chain can also be used instead of a rope 29.

Figure 13:
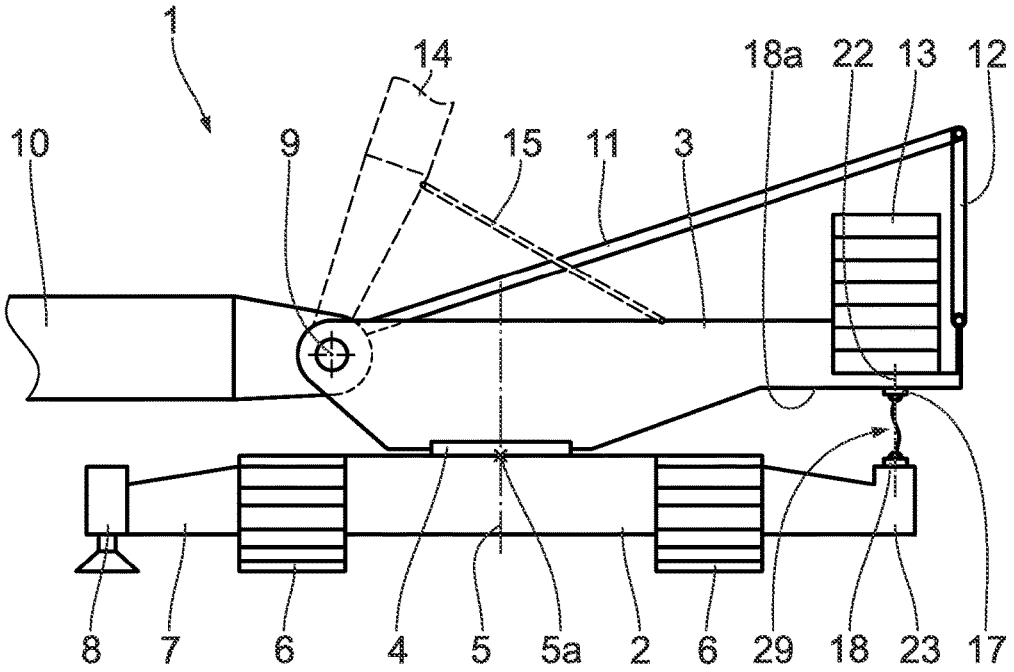
FIG. 13 shows a side view corresponding to that of FIG. 4A of a crane according to a further embodiment with a rope as the device.

FIG. 13 shows a further embodiment of a crane 1. Components that equal those explained above with reference to FIGS. 1 to 12 are identified with the same reference number and will not be discussed again in detail.

According to the embodiment shown the device with the force-transmitting element 29 is designed as a rope, connected to the under carriage 2 via the interim element 23 in such a way that the rope 29 is vertically oriented between connection elements 17, 18 in the maximum admissible load condition. A chain, belt or another non-rigid element can also be used as the tensile element instead of the rope 29.

Figure 14:
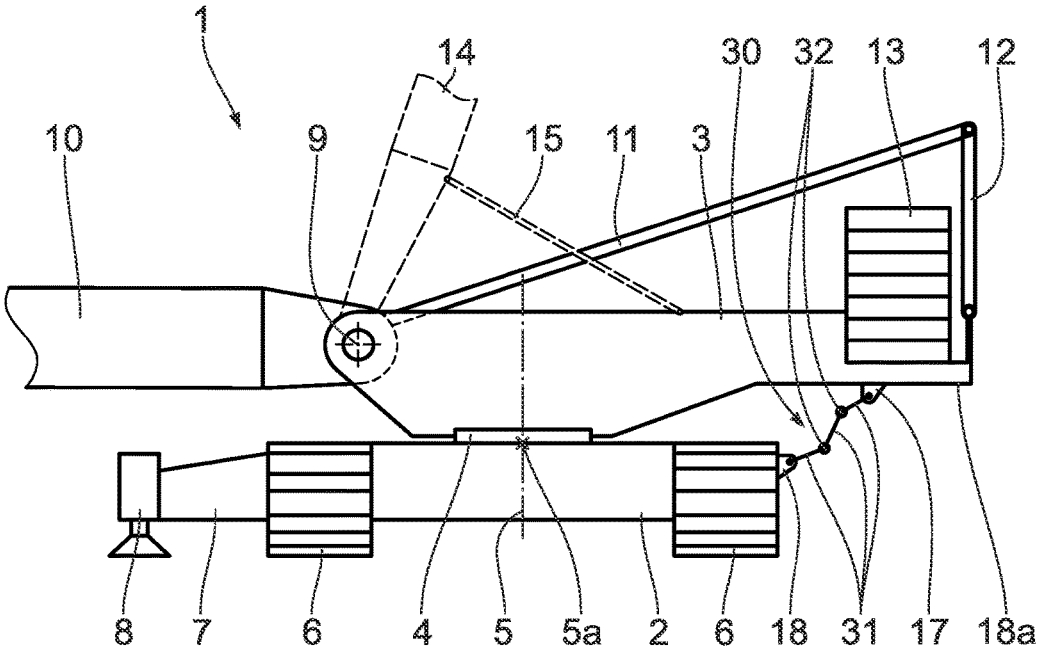
FIG. 14 shows a side view corresponding to that of FIG. 1 of a crane according to a further embodiment with rod segments with interim joints as the device.

FIG. 14 shows a further embodiment of a crane 1. Components that equal those explained above with reference to FIGS. 1 to 13 are identified with the same reference number and will not be discussed again in detail.

According to the embodiment shown the device comprises an arrangement 30 of rod segments 31 with interim joints 32 arranged between the same as force-transmitting elements. A maximum admissible load condition is reached when the rod segments 31 are arranged behind each other parallel to the virtual line 22. The interim joints 32 are in particular designed as toroidal bearings. These bearings also allow a dynamic attenuating function in addition to the static function of force transmission, in particular that of a torsion bearing. Forces between upper carriage 3 and under carriage 2 are redirected outside of the active surface of the rotary connection 4 via the force-transmitting element. Any force occurring is also advantageously and efficiently converted into friction heat.

Figure 15:
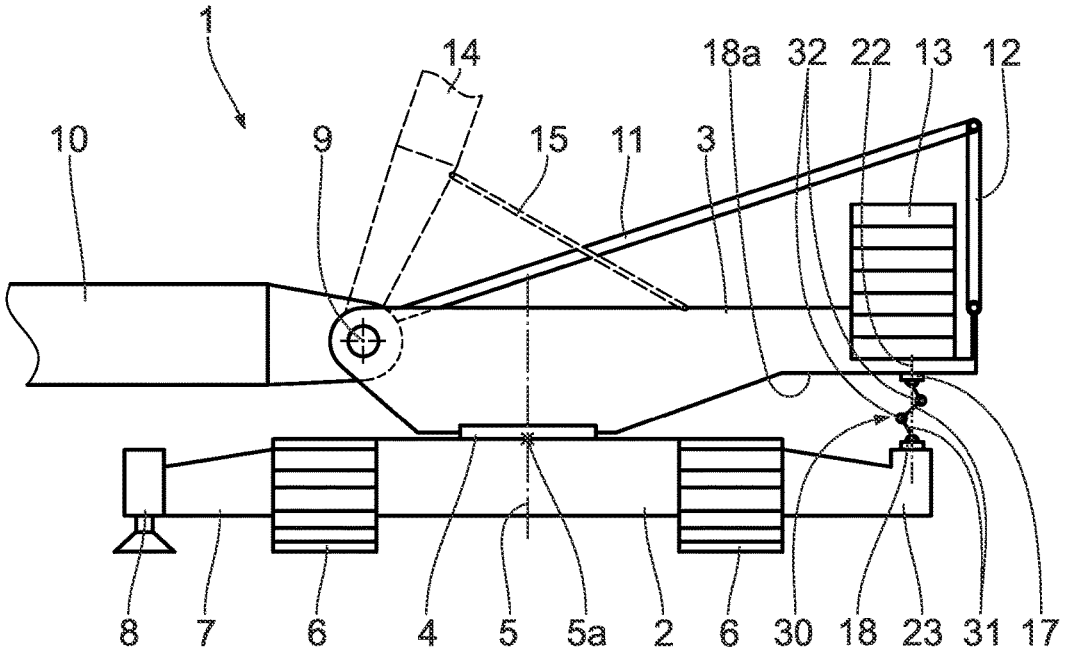
FIG. 15 shows a side view corresponding to that of FIG. 4A of a further embodiment of the crane with rod segments with interim joints as the device.

FIG. 15 shows a further embodiment of a crane 1. Components that equal those explained above with reference to FIGS. 1 to 14 are identified with the same reference number and will not be discussed again in detail.

The device equals the device with rod segments 31 and interim joints 32 arranged between the same according to FIG. 14. Only the linkage is different in that the connection elements 17, 18 are designed in such a way that the virtual line 22 between the upper carriage connection element 17 and the under carriage connection element 18 is oriented vertically in the maximum admissible load condition.

Figure 16:
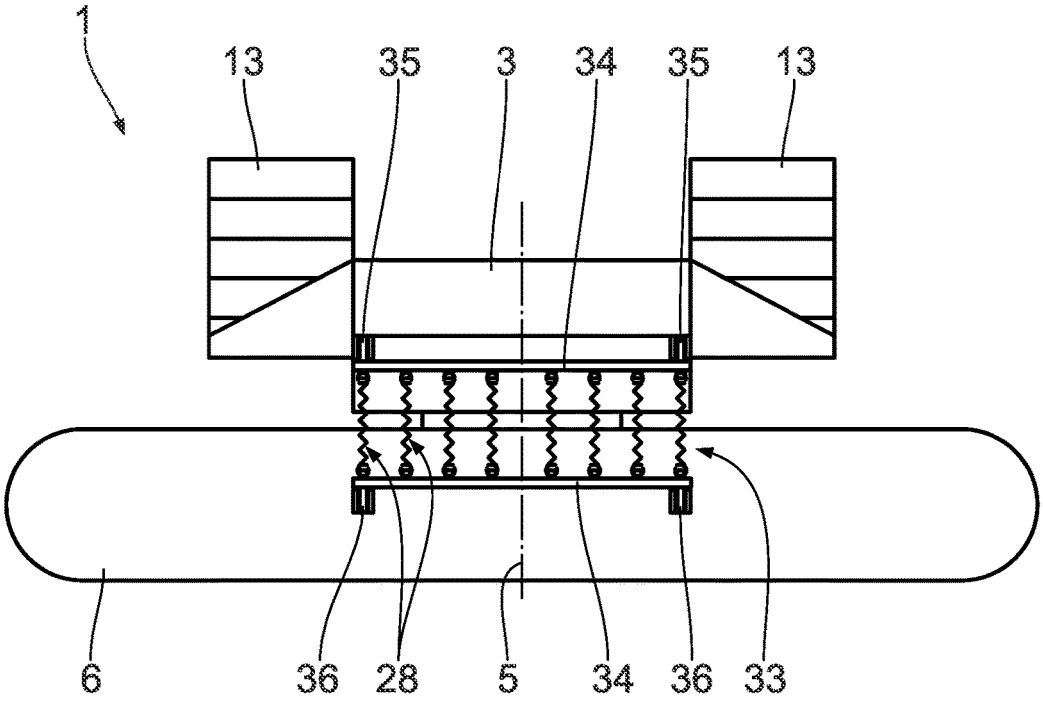
FIG. 16 shows a side view corresponding to that of FIG. 2 of a further embodiment of a crane with a device comprising several spring elements.

FIG. 16 shows a further embodiment of a crane 1. Components that equal those explained above with reference to FIGS. 1 to 15 are identified with the same reference number and will not be discussed again in detail.

The major difference compared to the previously described embodiments lies in that the device comprises several spring elements 28 arranged parallel next to each other as force-transmitting elements. According to the embodiment shown eight spring elements 28 are arranged next to each other. The spring elements 28 are held in a common installation frame 34. The installation frame 34 is linked to the upper carriage connection elements 35 and the under carriage connection elements 36. Individual spring elements 28 can be pre-assembled quickly in an uncomplicated way by means of the installation frame 34 and then installed together between upper carriage 3 and under carriage 2 on the crane 1. The replacement of individual spring elements 28 in particular is simplified. The pre-determined load condition to be tolerated can be set in a flexible way by adding or omitting individual spring elements 28 or replacing individual spring elements with spring elements of various spring stiffnesses.

FIGS. 17 to 20 show further embodiments of a crane 1. Components that equal those explained above with reference to FIGS. 1 to 16 are identified with the same reference number and will not be discussed again in detail.

The major difference compared to previous embodiments consists in the design of the device, which comprises a pressure element as the force-transmitting element 37. This means that the device is suitable for absorbing pressure forces and induces these from the upper carriage 3 into the under carriage 2 to take the load off the rotary connection 4. For this the device is arranged on the erection plane, which is on same side of the axis of rotation 5 as the jib 10, parallel to the drawing plane of FIG. 14. This means that the device is arranged on the erection plane between the axis of rotation 5 and the jib 10. A vertical distance $S_3$ of the force induction point of the device from the axis of rotation 5 is reduced compared to the previous embodiment examples.

Figure 17A:
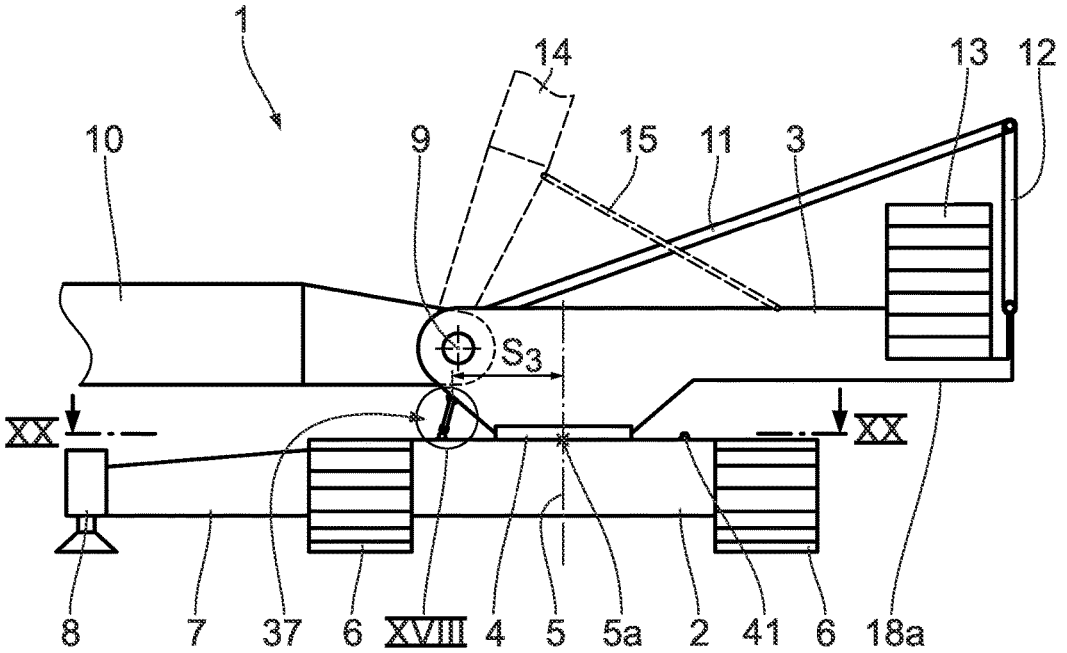
FIG. 17A shows a side view corresponding to that of FIG. 1 of a further embodiment of the crane with a pressure rod as the device.
Figure 17B:
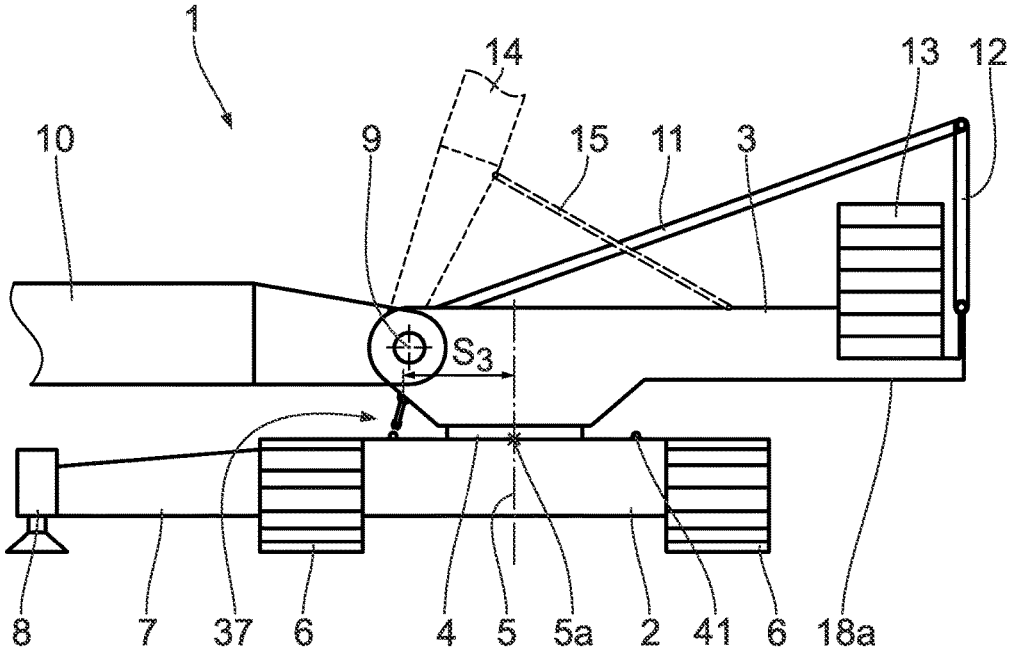
FIG. 17B shows a view corresponding to that of FIG. 17A in a discharged condition.

The force-transmitting element 37 is arranged with a castor 39 at a distance from a running track 41 in an unloaded arrangement according to FIG. 17B. A loaded arrangement of the force-transmitting elements 37, each designed as pressure element, is respectively shown in FIGS. 17A, 18 and 19. In these unloaded arrangements the castor 39 rests against the running track.

Figure 18:
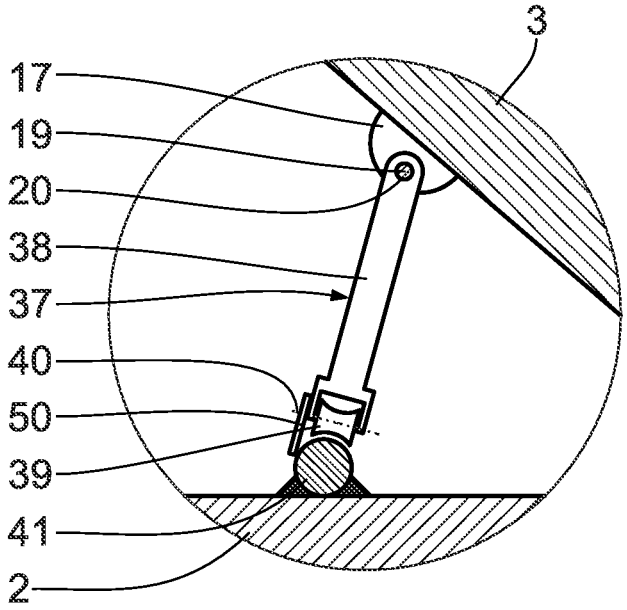
FIG. 18 shows an enlarged detail view of detail XVIII in FIG. 17A.

The device is shown in detail in FIG. 18. The pressure element 37 comprises a pressure rod 38 that is swivel-mounted on a bolt 19 on the upper carriage connection element 17. The pressure element 37 further comprises a cylinder body 39 on an end of the pressure rod 38 opposite the bolt opening 20, which is in particular designed as a castor. The castor 39 can roll around a running axis 40 oriented vertical to the longitudinal axis of the pressure rod 38. The castor 39 preferably has a concave surface when viewed in a cross-sectional illustration. The castor 39 has a cylindrical base form. The outer contour of the castor 39 is that of a twin-rotation hyperboloid. The outer contour of the castor 39 substantially equals an egg timer. The concave design of the castor 39 results from its cooperation with a running track 41, on which the device is supported with the castor 39. The running track 41 is in particular permanently fitted, in particular welded to a top of the under carriage 2. In this way it is possible that the crane 1 is rotatable around the axis of rotation 5 whilst the device is fitted according to the embodiment shown. In particular it is therefore not necessary to dismantle the device after the jib 10 has been erected. A track rail 50 prevents the derailing of the castor 39 from the running track 41. A defined transmission of normal and transverse forces between upper carriage and under carriage by the track rail 50 is not intended. The track rail 50 is intended only to prevent that the pressure rod 38 is lifted in such a way in an unloaded condition of the device 37 that the castor 39 is removed from the running track 41. The track rail 50 guarantees a safe guiding of the castor 39 along the running track 41, in particular also in a non-load situation of the pressure rod 38.

Figure 19:
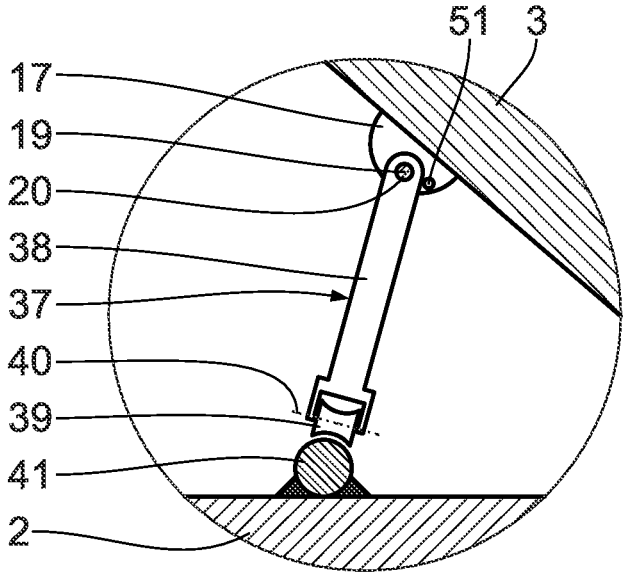
FIG. 19 shows an enlarged detail view corresponding to that of FIG. 18 of a further embodiment.
Figure 20:
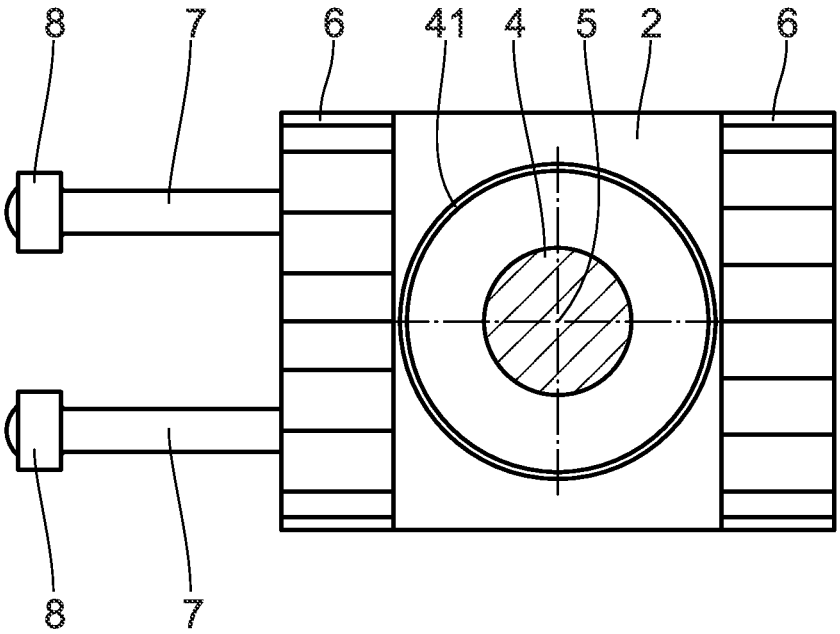
FIG. 20 shows a section illustration along section line XX-XX in FIG. 17A.

An alternative design to the track guide is illustrated in FIG. 19. A limiting bolt 51 is arranged directly on the upper carriage connection element 17. The limiting bolt 51 prevents that the pressure rod 38 swivels around the axis of the bolt 19 in an anti-clockwise direction during an unintended lifting of the pressure rod 38 with the castor 39 from the running track 41, in particular as a consequence of gravity, according to FIG. 19.

Alternatively the limiting bolt 51 can also be designed as a brace, i.e. as a welding point. The limiting bolt 51 or the brace serve as a side rotation prevention for preventing the derailing of the castor 39.

Alternatively the contour of the castor 39 can be designed according to an embodiment example not shown here, that the castor 39 secures itself against derailing. This is for example the case when the flanks of the twin-rotation hyperboloid are clearly raised, so that a tilting of the pressure rod 38 around the longitudinal axis of the bolt 19 is geometrically prevented. This is of advantage in particular when an expected deformation of the pressure rod is too great. Such a rotation prevention against derailing is cost effective.

As the inclination of the pressure rod 38 in relation to the under carriage 2 is in particular known a priori, the castor 39 can also be designed as a cylinder roll. It is also possible to simplify the device according to the embodiment example shown in that a rotatability between upper carriage 3 and under carriage 2 in relation to the axis of rotation 5 is not permitted, or only in as far as small angle ranges. In this case it is possible that the pressure rod 38 comprises a plate-like support element, in particular formed as a single piece, in particular welded on, instead of the castor 39. The pressure rod 38 can be removed together with the support element, in particular after a completed erection process, or swiveled in such a way that it will not be in the way during a rotation between upper carriage 3 and under carriage 2.

Figure 21:
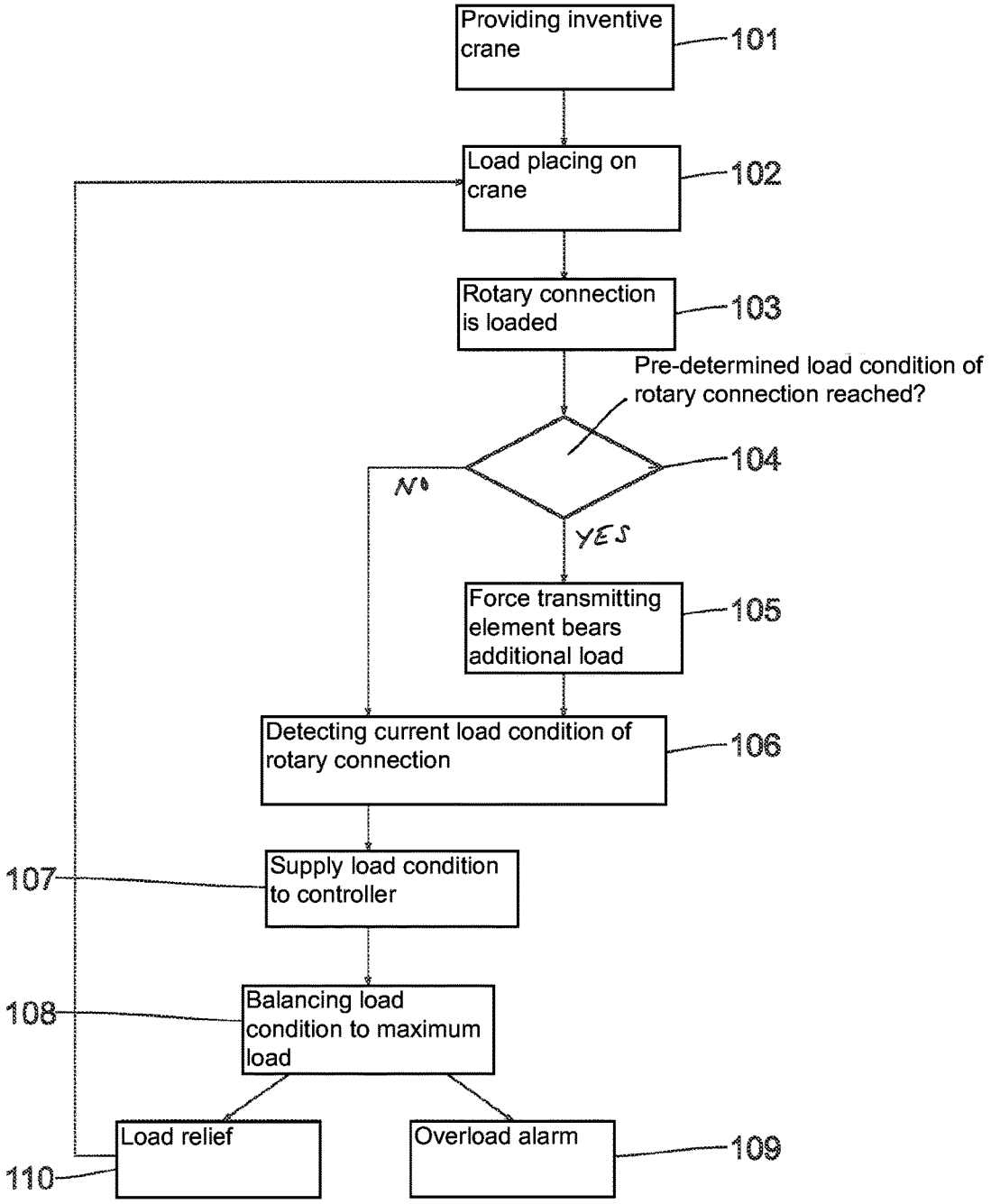
FIG. 21 shows a flow diagram for illustrating the method for deflecting forces on a crane.

A method for deflecting forces on the crane 1 will be explained in more detail hereafter with reference to FIG. 21. The crane 1 according to FIG. 1 has already been provided during a first method step 101. A load is placed on the crane 1 during method step 102. A load placed on the crane can for example result from erecting the jib 10. A load placed on the crane can also result in that a load is lifted and/or moved with the erected jib. During a further method step 103 a transmission of forces from the upper carriage 3 to the under carriage 2 or vice versa by means of the rotary connection 4 occurs. Depending on a pre-determined load condition of the rotary connection 4 an additional transmission of forces from the upper carriage 3 to the under carriage 2 or vice versa by means of at least one force-transmitting element 16 occurs. The query of whether the pre-determined load condition of the rotary connection 4 is reached is symbolised by the diamond during method step 104. When the pre-determined load condition of the rotary connection is reached, the additional transmission of forces from the upper carriage 3 to the under carriage 2 or vice versa by means of at least one force-transmitting element 16 according to method step 105 occurs. A pre-determined load condition of the rotary connection 4 is for example reached when a force effect between upper carriage 3 and under carriage 2 is arranged outside of an active surface of the rotary connection 4. In this case the force-transmitting element is activated. A detecting of a current load condition of the rotary connection 4 occurs during method step 106. This is realised in particular in that the forces acting on the rotary connection are determined by means of at least one sensor element. Detecting the load condition of the rotary connection is realised irrespective of whether the pre-determined load condition of the rotary connection is reached, i.e. in particular also without activating the force-transmitting element according to method step 105. A force sensor in the form of a strain gauge or a force capsule, or a combination of strain gauge and force capsule, for example serves as a sensor element. Such a force sensor is for example arranged on the device itself or in the area of a connection element 17, 18. Other sensors are also feasible, which for example serve for determining tension and/or deformation in the device. The sensors are in signal connection with a controller. The supply of the load condition of the rotary connection 4 detected by means of a sensor to the controller takes place during a method step 107. The load condition of the rotary connection 4 detected by the sensor, in particular in the controller, in particular in a balancing unit envisaged for this, is balanced against a maximum load value tolerated for the rotary connection 4, i.e. with a pre-determined load condition, during a method step 108. Depending on the result of this balancing further method steps can be initiated, in particular independently from each other. If the load condition of the rotary connection 4 detected by the at least one sensor reaches the pre-determinable load condition, a warning/alarm signal can be initiated by the controller and transmitted to an output device. This is illustrated as method step 109. In this case the controller is a monitoring device. The monitoring device can comprise a warning/alarm component, which generates the warning/alarm signal directly. The warning/alarm component is integrated into the monitoring device in this case. The monitoring device can also be in signal connection with an external warning/alarm component. Such a warning/alarm signal can be generated optically and/or acoustically.

It is also feasible that a load application process of the crane according to method step 102 is interrupted and/or an active load relief provided by means of method step 110 upon reaching the pre-determined load condition of the rotary connection 4. An active load relief can for example be realised by lowering the jib against an erection rotation movement and/or by lowering a load. In this case, controlling the influence on the crane operation by means of the controller is realised. As a starting parameter is provided as the input parameter, in particular in dependence on the load condition detected by the sensors, which can initiate an interruption and/or an active load relief of the crane, the controller also has a regulating function in this case.

The invention claimed is:

1. A crane, comprising:

an under carriage, an upper carriage, a rotary connection to connect the upper carriage with the under carriage to rotate around an axis of rotation, a jib erectable via a jib axis at the upper carriage, and a device connecting the upper carriage with the under carriage, comprising at least one passive force-transmitting element, wherein the upper carriage inclines and/or deforms around a horizontal axis due to an external load, wherein the horizontal axis is parallel to a jib axis and intersects the axis of rotation, wherein a distance between the upper carriage and the under carriage is length-adjustable by an idle stroke of the at least one passive force-transmitting element between a non-force-transmitting position and a force-transmitting position, wherein the idle stroke has a dimension exceeding typical fabrication tolerances of the at least one passive force-transmitting element, wherein the at least one passive force-transmitting element is in the force-transmitting position when a pre-determined load condition of the rotary connection is reached due to the inclination and/or deformation of the upper carriage, and wherein the at least one passive force-transmitting element in the force-transmitting position transmits forces between the upper carriage and the under carriage in addition to the rotary connection and takes off these forces from the rotary connection.

2. A crane according to claim 1, wherein the at least one passive force-transmitting element comprises two passive force-transmitting elements arranged on a force transmission plane symmetrical in relation to the axis of rotation, wherein the force transmission plane is oriented parallel to the horizontal axis and parallel to the axis of rotation.

3. A crane according to claim 1, wherein the at least one passive force-transmitting element is arranged parallel to the axis of rotation.

4. A crane according to claim 1, comprising at least one connection element to connect the device with at least one of the under carriage and the upper carriage.

5. A crane according to claim 1, wherein an interim element fitted to the under carriage is provided, on which the at least one connection element is arranged.

6. A crane according to claim 1, comprising an overload protection for detecting an overloading of the device.

7. A crane according to claim 1, wherein the at least one passive force-transmitting element is a tensile element for absorbing tensile forces being arranged at a rear side of the crane facing away from the jib.

8. A crane according to claim 7, wherein the tensile element is rigid.

9. A crane according to claim 7, wherein the tensile element is one of a traction rod, a rod segment with at least one interim joint, a pipe and a metal sheet.

10. A crane according to claim 7, wherein the tensile element is one of a rope, a chain and a belt.

11. A crane according to claim 7, wherein the tensile element is a spring element coupled with at least one attenuator.

12. A crane according to claim 7, comprising several tensile elements of the device, which are arranged in an installation frame.

13. A crane according to claim 7, wherein the tensile element is non-rigid.

14. A crane according to claim 1, wherein the force-transmitting element is a compressive element absorbing compressive forces being arranged at a rear side of the crane facing towards the jib.

15. A crane according to claim 1, wherein the device is guidable and displaceable with an end facing the under carriage along one of a holding track and a running track.

16. A crane according to claim 15, wherein a tensile element comprises at least one of at least one glide element and at least one guide element at an end facing the under carriage, which is arranged on the holding track circumferentially around the axis of rotation.

17. A crane according to claim 15, wherein the pressure element is a pressure rod, comprising at least one cylinder body at an end facing the under carriage, which is arranged on the running track circumferentially around the axis of rotation.

18. A crane according to claim 1, further comprising a bolt for connecting the at least one passive force-transmitting element to one of the upper carriage or the under carriage, wherein the at least one passive force-transmitting element comprises an oblong hole defined in an end of the at least one passive force-transmitting element connected to the one of the upper carriage or the under carriage, and wherein the bolt is configured and disposed to fit into and slide along the oblong hole as the idle stroke moves from the non-force-transmitting position and a force-transmitting position.

19. A device for a crane comprising an under carriage, an upper carriage, a rotary connection to connect the upper carriage with the under carriage to rotate around an axis of rotation, a jib erectable via a jib axis at the upper carriage, and a device connecting the upper carriage with the under carriage, comprising at least one passive force-transmitting element, wherein the upper carriage inclines and/or deforms around a horizontal axis due to an external load, wherein the horizontal axis is parallel to a jib axis and intersects the axis of rotation, wherein a distance between the upper carriage and the under carriage is length-adjustable by an idle stroke of the at least one passive force-transmitting element between a non-force-transmitting position and a force-transmitting position, wherein the idle stroke has a dimension exceeding typical fabrication tolerances of the at least one passive force-transmitting element, wherein the at least one passive force-transmitting element is in the force-transmitting position when a predetermined load condition of the rotary connection is reached, and wherein the at least one passive force-transmitting element in the force-transmitting position transmits forces one of from the upper carriage to the under carriage and vice versa in addition to the rotary connection and takes off these forces from the rotary connection.

* * * * *